US007677210B2

(12) United States Patent
Chasin et al.

(10) Patent No.: US 7,677,210 B2
(45) Date of Patent: Mar. 16, 2010

(54) ROTATING BARREL TYPE INTERNAL COMBUSTION ENGINE

(76) Inventors: Lawrence C. Chasin, 133 Mulberry St., Suite 6W, New York, NY (US) 10013; Douglas M. Johns, 20367 Callon Dr., Topanga, CA (US) 90290; Aaron Barere, 1027 Park Ave., Hoboken, NJ (US) 07030; Christopher E. Gardner, 216 Locust Dr., Cranford, NJ (US) 07016

( * ) Notice: Subject to any disclaimer, the term of this patent is extended or adjusted under 35 U.S.C. 154(b) by 450 days.

(21) Appl. No.: 11/611,018

(22) Filed: Dec. 14, 2006

(65) Prior Publication Data

US 2007/0169728 A1 Jul. 26, 2007

Related U.S. Application Data

(60) Provisional application No. 60/750,248, filed on Dec. 14, 2005, provisional application No. 60/772,952, filed on Feb. 14, 2006, provisional application No. 60/778,294, filed on Mar. 2, 2006, provisional application No. 60/864,907, filed on Nov. 8, 2006.

(51) Int. Cl.
*F02B 57/00* (2006.01)
*F02B 75/26* (2006.01)

(52) U.S. Cl. ..... 123/56.1; 123/43 R

(58) Field of Classification Search ..... 123/56.1–56.3, 123/56.6, 56.9, 43 R, 43 A, 43 AA, 43 B, 123/43 C, 44 E

(56) References Cited

U.S. PATENT DOCUMENTS

| | | | | |
|---|---|---|---|---|
| 225,651 | A | 3/1880 | Silver | |
| 839,300 | A | 12/1906 | Krohn | |
| 848,665 | A | 4/1907 | Lombard | 123/43 A |
| 892,804 | A | 7/1908 | Burbank | 123/43 A |

(Continued)

FOREIGN PATENT DOCUMENTS

| | | | |
|---|---|---|---|
| DE | 247383 | 5/1912 | 123/43 A |

(Continued)

OTHER PUBLICATIONS

J. C. McLanahan (Salem State College, MA) , AIAA and SAE, 1998 World Aviation Conference, Anaheim, CA, Sep. 28-30, 1998.

(Continued)

*Primary Examiner*—Hai H Huynh
(74) *Attorney, Agent, or Firm*—Steven M. Koehler; Westeman, Champlin & Kelly, P.A.

(57) ABSTRACT

An internal combustion barrel engine having rotating cylinders and pistons which together form combustion spaces. The combustion spaces are maintained at a substantially constant volume while a compressed air-fuel mixture is combusted therein.

41 Claims, 27 Drawing Sheets

U.S. PATENT DOCUMENTS

| | | | | | |
|---|---|---|---|---|---|
| 893,181 | A | | 7/1908 | Macomber | |
| 928,715 | A | | 7/1909 | Thurber | 123/43 AA |
| 933,316 | A | | 9/1909 | Macomber | 123/43 A |
| 968,969 | A | | 8/1910 | Ord | |
| 972,869 | A | | 10/1910 | Jones | |
| 980,491 | A | | 1/1911 | Coleman | |
| 1,019,521 | A | | 3/1912 | Pratt | |
| 1,042,018 | A | | 10/1912 | Macomber | |
| 1,116,768 | A | | 11/1914 | Underwood | |
| 1,152,004 | A | * | 8/1915 | Canton | 92/70 |
| 1,219,377 | A | | 3/1917 | Davidson | |
| 1,255,664 | A | | 2/1918 | Syger | |
| 1,275,494 | A | | 8/1918 | Storle | 123/43 A |
| 1,277,964 | A | | 9/1918 | Lovelace | 123/43 A |
| 1,307,045 | A | * | 6/1919 | Galbreath | 123/41.63 |
| 1,332,756 | A | | 3/1920 | Root | |
| 1,345,808 | A | | 7/1920 | Reynolds | |
| 1,405,224 | A | | 1/1922 | Kenmoth | |
| 1,476,275 | A | * | 12/1923 | Wishon | 123/56.6 |
| 1,604,474 | A | | 10/1926 | Nisbet | |
| 1,696,676 | A | | 12/1928 | Fuhr | |
| 1,779,032 | A | | 10/1930 | Cathcart | |
| 1,825,691 | A | | 10/1931 | Hall | |
| 1,880,224 | A | | 10/1932 | Wilsey | 123/43 A |
| 1,895,206 | A | | 1/1933 | Ricardi | 123/51 B |
| 1,950,970 | A | | 3/1934 | Chilton | 123/51 B |
| 1,961,905 | A | | 6/1934 | Michell | 123/51 B |
| 1,986,584 | A | | 1/1935 | Koplar | |
| 1,987,699 | A | | 1/1935 | Moore | |
| 2,080,846 | A | | 5/1937 | Alfaro | 123/51 B |
| 2,222,294 | A | | 11/1940 | Hall | 123/56.5 |
| 2,229,246 | A | | 1/1941 | Istad | 123/51 B |
| 2,276,772 | A | | 3/1942 | Heap | 123/43 AA |
| 2,329,480 | A | | 9/1943 | Neuland | |
| 2,337,543 | A | | 12/1943 | Christopher | |
| 2,342,900 | A | | 2/1944 | Sandell | 123/51 B |
| 2,354,620 | A | | 7/1944 | Smith | 123/51 B |
| 2,368,933 | A | | 2/1945 | Linderman | |
| 2,369,002 | A | | 2/1945 | Wilson | 123/43 A |
| 2,382,280 | A | | 8/1945 | Allison | |
| 2,387,908 | A | | 10/1945 | Howard | |
| 2,406,292 | A | | 8/1946 | Hall | |
| 2,430,753 | A | | 11/1947 | Ziska | |
| 2,456,164 | A | | 12/1948 | Youhouse | 123/43 A |
| 2,512,265 | A | | 6/1950 | Brigaudet | |
| 2,513,083 | A | | 6/1950 | Eckert | |
| 2,556,585 | A | | 6/1951 | Jarvinen | 123/43 AA |
| 2,776,649 | A | | 1/1957 | Fenske | 123/43 A |
| 3,007,462 | A | | 11/1961 | Balzer | |
| 3,196,698 | A | * | 7/1965 | Liddington | 74/60 |
| 3,528,394 | A | | 9/1970 | Cummins | |
| 3,536,050 | A | * | 10/1970 | Denis | 123/51 A |
| 3,608,530 | A | * | 9/1971 | Wenzel | 123/53.4 |
| 3,654,906 | A | | 4/1972 | Airas | 123/43 A |
| 3,695,237 | A | | 10/1972 | Londo | 123/43 A |
| 3,731,593 | A | * | 5/1973 | Chivari | 91/487 |
| 3,807,370 | A | | 4/1974 | Baugh | |
| 3,830,208 | A | | 8/1974 | Turner | |
| 3,902,468 | A | | 9/1975 | Turner | 123/43 A |
| 3,905,338 | A | | 9/1975 | Turner | 123/43 A |
| 3,939,809 | A | | 2/1976 | Rohs | 123/43 A |
| 3,945,359 | A | | 3/1976 | Asaga | |
| 3,968,776 | A | | 7/1976 | Rund | |
| 3,970,055 | A | | 7/1976 | Long | 123/43 A |
| 3,973,531 | A | | 8/1976 | Turner | 123/43 A |
| 4,060,060 | A | | 11/1977 | Turner | 123/43 A |
| 4,077,269 | A | | 3/1978 | Hodgkinson | |
| 4,144,771 | A | | 3/1979 | Kemper et al. | 74/60 |
| 4,149,498 | A | | 4/1979 | Perrell | |
| 4,433,596 | A | | 2/1984 | Scalzo | |
| 4,538,557 | A | * | 9/1985 | Kleiner et al. | 123/78 E |
| 4,620,475 | A | | 11/1986 | Watts | |
| 4,622,885 | A | | 11/1986 | Schriwer | |
| 4,624,175 | A | | 11/1986 | Wahlmark | |
| 4,648,358 | A | | 3/1987 | Sullivan et al. | |
| 4,779,579 | A | | 10/1988 | Sukava | 123/43 A |
| 4,960,082 | A | | 10/1990 | Sullivan | |
| 4,996,953 | A | * | 3/1991 | Buck | 123/51 A |
| 5,027,755 | A | | 7/1991 | Weston | |
| 5,070,825 | A | | 12/1991 | Morgan | 123/43 A |
| 5,103,778 | A | | 4/1992 | Usich | 123/999.999 |
| 5,159,902 | A | | 11/1992 | Grimm | 123/43 A |
| 5,209,190 | A | | 5/1993 | Paul | |
| 5,215,045 | A | | 6/1993 | Vadnjal | |
| 5,323,738 | A | | 6/1994 | Morse | 123/43 AA |
| 5,601,055 | A | | 2/1997 | Haines | 123/43 A |
| 5,904,044 | A | | 5/1999 | White | 123/48 C |
| 6,240,885 | B1 | * | 6/2001 | Hanson | 123/55.5 |
| 6,834,636 | B2 | * | 12/2004 | Thomas et al. | 123/241 |
| 6,925,974 | B2 | * | 8/2005 | Yoon | 123/56.1 |
| 7,210,429 | B2 | * | 5/2007 | Johns | 123/43 A |
| 7,219,633 | B1 | * | 5/2007 | McLeod | 123/56.6 |
| 7,464,673 | B2 | * | 12/2008 | Thomas et al. | 123/56.8 |
| 2003/0131807 | A1 | | 7/2003 | Johns | |
| 2004/0118365 | A1 | | 6/2004 | Brueckmueller | |

FOREIGN PATENT DOCUMENTS

| | | |
|---|---|---|
| EP | 0081205 | 6/1983 |
| EP | 0563378 | 4/1998 |
| GB | 15490 | 0/1913 |
| GB | 189246 | 11/1992 |
| NO | 28632 | 6/1919 |
| WO | WO 98/59160 | 12/1998 |

OTHER PUBLICATIONS

More Power from Less Engine, SAE Journal (Transactions), vol. 47, No. 6, pp. 504-519, Dec. 1940.

B. Tripolsky, "Bricklin Comes Back With A Rotary Engine" Mechanix Illustrated, pp. 50-51, Jan. 1977.

Official Search Report of the European Patent Office in counterpart foreign application No. PCT/US2006/047791 filed Dec. 14, 2006.

* cited by examiner

ROTATING BARREL TYPE INTERNAL COMBUSTION ENGINE

CROSS-REFERENCE TO RELATED APPLICATIONS

This application claims the benefit of the following U.S. Provisional Patent Application Ser. No. 60/750,248, filed Dec. 14, 2005, Ser. No. 60/772,952, filed Feb. 14, 2006, Ser. No. 60/778,294, filed Mar. 2, 2006 and Ser. No. 60/864,907, filed Nov. 8, 2006, all of which are hereby incorporated by reference in their entirety.

BACKGROUND

The discussion below is merely provided for general background information and is not intended to be used as an aid in determining the scope of the claimed subject matter.

The present invention relates to engines of all sorts. More particularly, the present invention relates to an internal combustion engine of a barrel-type configuration in which the cylinder axes are arranged around a central longitudinal axis of the engine, and even more particularly to a barrel-type engine having a rotating cylinder bank.

Internal combustion engines have been around for a long time. The basic components of the engine are well known in the art and include the engine block, cylinder head, cylinders, pistons, valves, crankshaft and camshaft. The cylinder heads, cylinders and tops of the pistons typically form combustion chambers into which fuel and air are introduced so that combustion takes place. Useful work is generated from the hot, gaseous products of combustion acting directly on the top or crown surface of the piston. Generally, reciprocating linear motion of the pistons within the cylinders is transferred to rotary motion of a crankshaft via connecting rods. One common internal combustion engine is known as an Otto-type internal combustion engine and employs a four-stroke cycle in which power is derived from the combustion process over four separate pistons movements (strokes): intake stroke, compression stroke, expansion (power) stroke, and exhaust stroke. In traditional Otto-type automotive engine applications, the cylinders are typically stationary and are typically arranged in one of three ways: (1) a single row (in line) with the centerlines of the cylinders commonly vertically oriented; (2) a double row with the centerlines of opposite cylinders converging in a V (V-engine); or (3) two horizontal, opposed rows (opposed or pancake engine). Two additional Otto-type cylinder configurations were also experimented with, primarily between 1900 and 1950, and include (1) a radial configuration where the cylinder axes are arranged like spokes of a wheel with the lower rod ends mounted on a common crank shaft journal, and (2) a barrel configuration with cylinder axes arranged parallel around the central longitudinal axis of the engine. Barrel configurations generally include a stationary cylinder bank and the power is transferred to the crankshaft in one of three ways (1) with the lower ends of the connecting rods connected to a gear arrangement, (2) with the lower ends of the crankshaft connected to a wobble plate, and (3) with the lower ends of the rods pushing a cam surface.

A subclass of barrel engines are those with a rotating cylinder bank and such engines generally come in one of three configurations: (1) a two or four-cycle arrangement in which the rotating cylinder bank drives an angled thrust plate from which power is taken off as shown by way of example in U.S. Pat. Nos. 980,491; 1,345,808; 2,382,280 and 4,779,579; (2) a two-cycle arrangement in which a pair of rotating cylinder banks share a common cylinder head unit and in which the outer rod ends each drive an angled thrust plate as shown by way of example in U.S. Pat. Nos. 968,969; 1,255,664 and 1,779,032; and (3) a two-cycle arrangement in which a pair of rotating cylinder banks share a common piston and in which a pair cylinder head units are provided at each end thereof as shown by way of example in U.S. Pat. Nos. 3,830,208 and 5,103,778. It is believed, both radial and barrel engines, in particular, fell out of favor after World War II.

Beginning in the early part of the twentieth century, the conventional Otto-type reciprocating engine began to assume dominance as the most practical approach, even though it was recognized that the thermodynamic efficiency of the engine was such that about two-thirds of the energy developed through the combustion of the fuel was wasted. That is, roughly ⅓ of the fuel energy is delivered to the crankshaft as useful work, ⅓ is lost in waste heat through the cylinder walls, heads and pistons, and ⅓ is lost out of the exhaust.

The Wankel engine, which is also known as a rotary engine, is denoted as such because it utilizes a single triangular rotating piston which forms combustion chambers as it rotates within a stationary figure eight-shaped "cylinder". The Wankel engine does not employ connecting rods as the rotating piston is linked directly to the crankshaft. The Wankel engine is also a four-stroke cycle engine, and while it has several advantages over the Otto-type engine, it produces higher emissions, has a shorter lifespan, and lacks torque at low speeds, which leads to greater fuel consumption.

Applicant's U.S. Patent Application Publication No. 2003/0131807 provides an improved barrel configuration with a rotating cylinder bank and angled thrust plate. However, it is always desirable to make improvements such as but not limited to improvements in thermodynamic efficiency, emissions, manufacturability, and/or power or torque of the engine.

SUMMARY

The Summary and Abstract are provided to introduce a selection of concepts in a simplified form that are further described below in the Detailed Description. The Summary and Abstract are not intended to identify key features or essential features of the claimed subject matter, nor are they intended to be used as an aid in determining the scope of the claimed subject matter. In addition, the claimed subject matter is not limited to implementations that solve any or all disadvantages noted in the Background.

An aspect of the present invention is an internal combustion barrel engine having rotating cylinders and pistons which together form combustion spaces. The combustion spaces are maintained at a substantially constant volume while a compressed air-fuel mixture is combusted therein. Using various design orientations, relationships, positions, tilts and/or offsets of the rotating cylinders and thrust plate to which the pistons are connected, a dwell can be obtained where the piston remains substantially stationary with respect to the corresponding cylinder when transitioning from a compression stroke to a power stroke and/or control the speed of the piston during various portions of the cycle.

In one embodiment, an engine block assembly includes a stationary housing, a cylinder bank rotatably mounted to the housing about a central longitudinal axis, the cylinder bank having a plurality of cylinders therein radially distanced from the central longitudinal axis, each cylinder having associated therewith a cylinder wall formed about a major cylinder axis, a plurality of pistons wherein one piston is provided in each cylinder to form a combustion chamber therein, wherein each piston sequentially moves from a down most position within the cylinder to an up most position within the cylinder during a first portion of rotation of the cylinder bank, wherein each piston sequentially dwells about the up most position for substantially all of an air-fuel mixture to be combusted within the combustion chamber, and wherein each piston then sequentially moves from about the up most position to the down most position during a second portion of rotation of the cylinder, a plurality of connecting rods each having a proximal end attached to a respective piston, and a remote end distant from the respective piston, a thrust plate operatively connected to the remote ends of the connecting rods, the thrust plate being rotatably mounted to the stationary housing about a thrust plate axis and in a thrust plane defined by the remote ends of the connecting rods, a synchronizing member operatively connecting to the cylinder bank and the thrust plate so that the cylinder bank and thrust plate rotate at the same speed. The piston dwell motion is created by adjusting one or more of the following design parameters: (1) the angle of the thrust plane with respect to a plane that is perpendicular to the central longitudinal axis, (2) the angular rotational offset of the thrust plate about an axis which is parallel to the central longitudinal axis and which intersects the thrust plate axis, (3) the angular rotational offset of the thrust plate about the thrust plate axis with respect to a reference point in the thrust plane, (4) the lateral offset of the thrust plate axis from the central longitudinal axis, and (5) the tilt of the major cylinder axes with respect to the central longitudinal axis.

These and other aspects will be described further below.

DETAILED DESCRIPTION

In the description below various exemplary embodiments of engines will be described. It should be understood that aspects of the exemplary embodiments are not limited to the embodiment in which such aspects are described, or in other words, such aspects can be included on any other exemplary embodiment herein described or other embodiments beyond those described, if desired. Where relevant in the description references will be made to the various embodiments when describing similar or alternative aspects, components or mechanisms.

Figure 1:
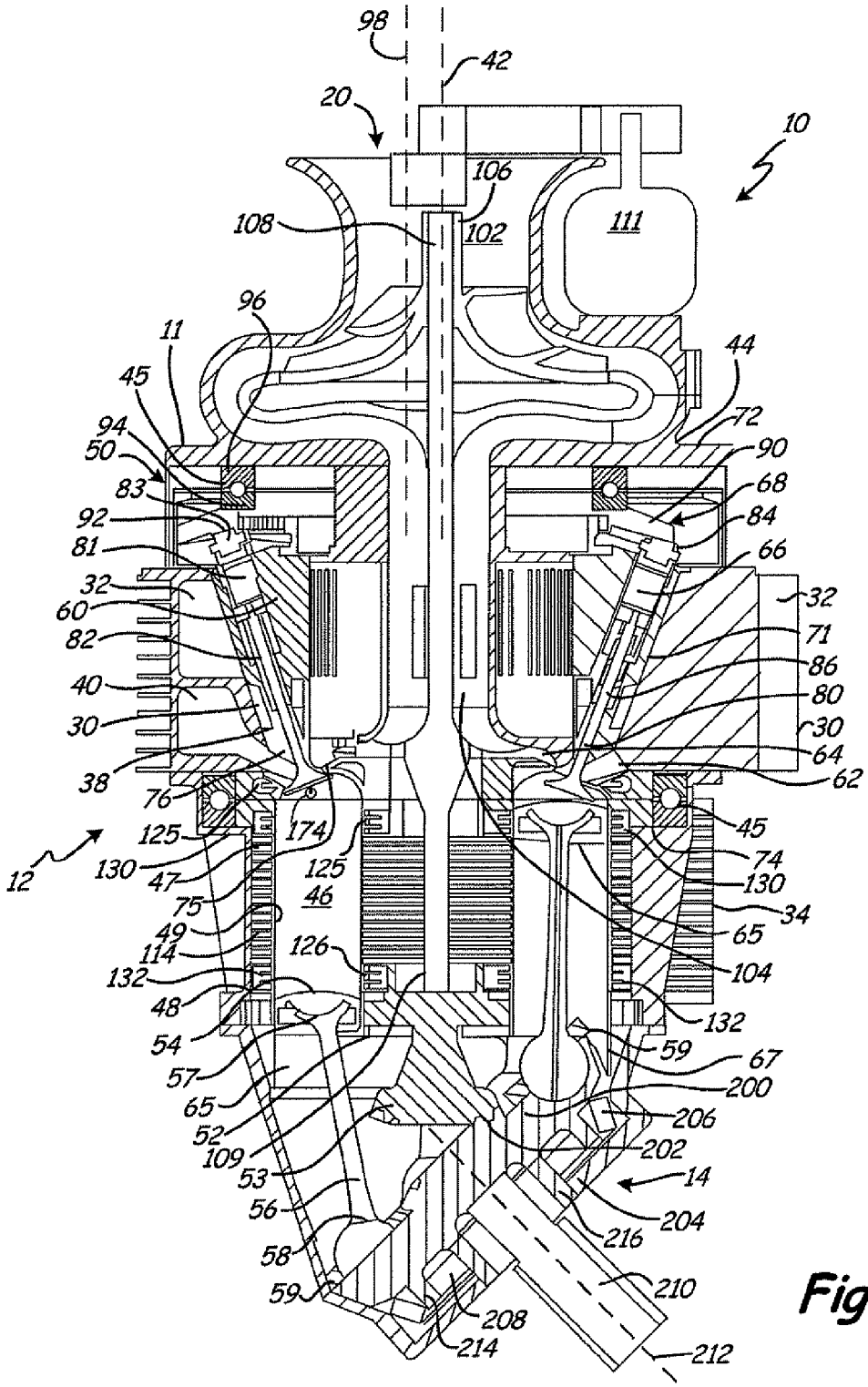
FIG. 1 is a sectional view of a rotating barrel engine.
Figure 2:
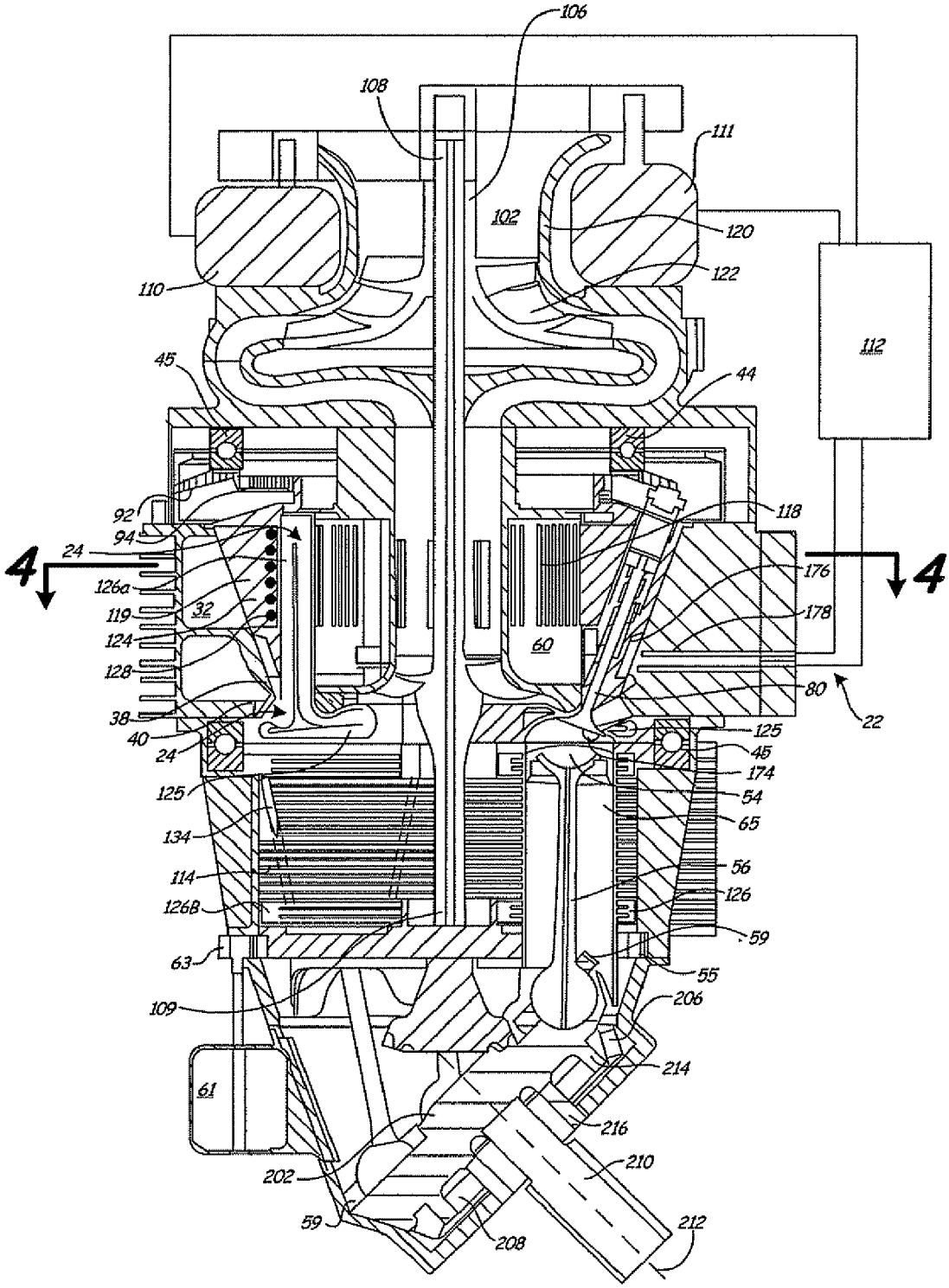
FIG. 2 is another sectional view of a rotating barrel engine of FIG. 1.

FIGS. 1 and 2 illustrate an exemplary rotating four-cycle barrel type internal combustion engine 10 having aspects of the present invention. Other embodiments are provided below. In the exemplary embodiment, engine 10 includes a stationary housing assembly 11, rotating cylinder bank assembly 12 for power generation, a power take-off assembly 14 for generating torque, a fuel delivery system 16 (FIG. 5) for regulating the fuel intake to the engine 10, a scavenging system 18 to minimize engine emissions, an air delivery system 20 for charging the fuel, cooling the cylinder bank assembly 12 and scavenging, an ignition system 22 for igniting the fuel, and a liquid cooling system as represented by passageway 24 (FIG. 2) for cooling the cylinder bank assembly 12. It should be understood that aspects of the present invention are not limited to an engine having all parts to operate. For instance, aspects of the present invention can be included in an engine block assembly having, for example, cylinders and pistons with or without a power take-off assembly or other subsystems such as a fuel delivery system, ignition system, cooling system, air delivery system, etc. As appreciated by those skilled in the art these and other subsystems can take any number of forms in order to provide an operable engine.

In the exemplary embodiment, a four-stroke cycle operation is provided in the course of two complete revolutions of the engine 10 as follows: an intake stroke ranging from about 0□ to about 180□ of the first revolution of the engine 10, a compression stroke ranging from about 180° to about 360° of the first revolution, a power stroke ranging from about 360° to about 540° of the second revolution, and an exhaust stroke ranging from about 540° to about 720° of the second revolution. It should be noted that the aforementioned and following degree ranges are for purposes of understanding only. The degree ranges may be adjusted to affect the power, speed, torque, fuel economy and/or emission quality for each application of the engine 10.

Figure 6:
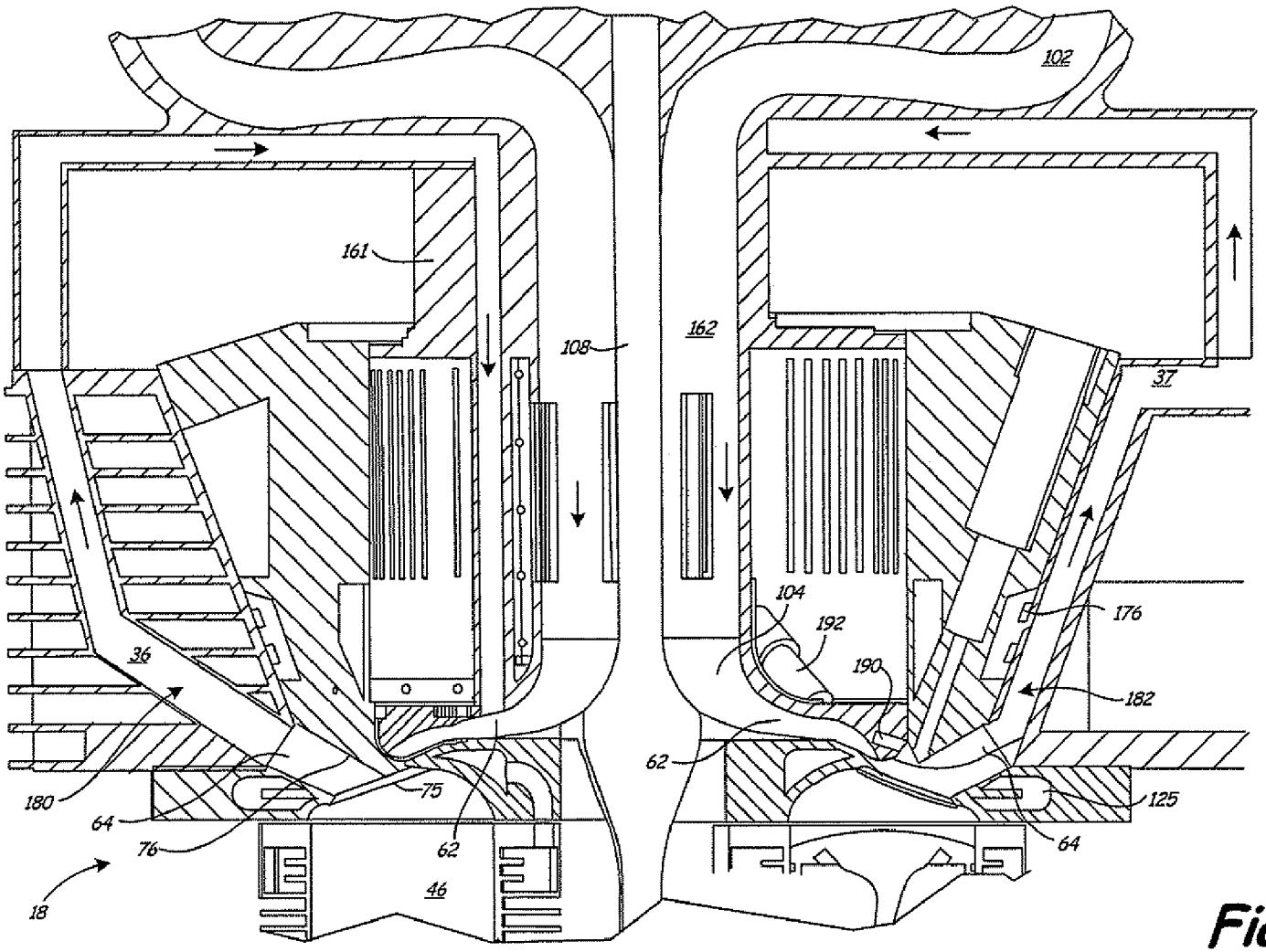
FIG. 6 is a enlarged sectional view of a cylinder head assembly.

The stationary housing assembly 11 houses and secures the engine in a relative stationary position such as, but not limited to, for pumps or generators, or in a vehicle (not shown, but without limitation including any vehicle operable on/in land, water and/or air). The housing assembly includes a combustion exhaust manifold 30, a cylinder head cooling exhaust manifold 32, a cylinder cooling exhaust manifold 34, and a pair of scavenging exhaust manifolds 36 and 37 (FIG. 6). A seal 38 (FIG. 1) within the combustion exhaust manifold 30 prevents exhaust fumes from leaking out of the manifold 34. A back pressure passageway 40 provides air at a higher pressure than the exhaust gases to ensure that exhaust gases do not leak past the seal 38. The manifolds 30, 32, and 34 can have longitudinal cooling fins extending from an exterior thereof to provide both improved heat transfer and improved structural support. The combustion exhaust manifold 30 is exposed from about 185° to about 350° to coincide with the exhaust stroke of the engine 10. The cylinder head exhaust manifold 32 and cylinder cooling manifold 34 can be exposed during the entire 360°. revolution of the engine, and the heated air stream generated may be used for other purposes such as to heat a passenger compartment of the vehicle. The combustion exhaust manifold 30, the cylinder head cooling exhaust manifold 32, and the cylinder cooling exhaust manifold 34 may be spiraled to more efficiently remove the gases from the engine 10. Referring also to FIG. 6, the scavenging system 18 includes a stationary pre-exhaust scavenging manifold 36 positioned near bottom dead center of the engine for directing unburned fuel scavenged from the cylinder bank assembly 12 back into the fuel delivery system to improve emissions, and a post exhaust scavenging manifold 37 positioned near top dead center of the engine for directing all residual burned fuel scavenged from the cylinder bank assembly 12 back into the fuel delivery system 16 to improve emissions, as will be further explained below.

The cylinder bank assembly 12 is rotatably mounted to the stationary housing 11 about a central longitudinal axis 42 and for example using suitable bearings such as bearings 44 and 45. The cylinder bank assembly 12 includes a plurality of cylinders 46 each having an upper end 47, a lower end 48 and a cylinder wall 49, a cylinder head assembly 50 mounted to the upper end 47 of the cylinders 46 for rotation therewith, a cylinder carriage 52 mounted to the lower end 48 of the cylinders 46 for rotation therewith and having a synchronizing gear 53 thereon for transferring torque to the power take-off assembly 14 and a starter gear 55 on a peripheral surface thereof, a plurality of pistons 54 each of which is moveable within a respective one of the plurality of cylinders 46 between an up position and a down position as the cylinder bank assembly 12 rotates, a plurality of connecting rods 56 each of which has an inner end 57 connected to the underside of a respective one of the plurality of pistons 54 and an outer end 58 operatively connected to the power take off assembly 14 via retainers 59 so that the outer end 58 of the rod 56 freely rotates and pivots as necessary as the cylinder bank assembly 12 rotates. The pistons 54 can each have a partial skirt 65 extending from an underside thereof and providing an improved wear surface against the cylinder wall 49 while at the same time minimizing piston weight. The cylinder walls 49 can have a corresponding partial skirt 67 for supporting the pistons skirt 65 and at the same time minimizing weight of the rotating mass. Centripetal force of the rotating cylinder bank assembly 12 should keep the piston skirts 65 oriented towards the outside of the cylinders 46 where the wear is greatest. Should the pistons rotate within the cylinder as the cylinder bank rotates than it would be desirable to use a fully skirted piston rather than the partial skirt 65. A starter motor 61 (FIG. 2) operatively connected to the stationary housing 11 includes a gear 63 which meshes with the starter gear 55 on the cylinder carriage 52 for initiating rotation of the cylinder bank assembly 12.

The cylinder head assembly 50 includes a head unit 60 having an intake port 62 and an exhaust port 64 positioned adjacent to each of the plurality of cylinders 46, a valve assembly 66 for opening and closing the intake port 62 and the exhaust port 64 to the cylinders in a timed sequence, and a cam assembly 68 for controlling the valve assembly 66. The head unit 60 is shown dough-nut shaped having an inner surface 70, an outer surface 71, an upper surface 72 and a lower surface 74. With respect to each cylinder, the lower surface 74 of the head unit 60 includes a domed shaped valve seat 75 separating the intake and exhaust ports 62 and 64 from the cylinders and a wall 76 separating the intake port 62 from the exhaust port 64 from each other. The valve assembly 66 controls the opening and closing of the intake port 62 and the exhaust port 64 with respect to the cylinders 46 by sealing against the valve seat 75. The combustion exhaust manifold 30 controls access to the exhaust port 62 while the fuel delivery system 16 controls access to the intake port 64.

The valve assembly 66 includes a valve 80, a valve lifter 81, a valve return spring 82, a tracking roller 83, and a retainer 84. Each valve 80 is disposed in the head unit 60 for sealing a respective cylinder 46 from the intake port 62 and the exhaust port 64 thereof and is built to withstand the full pressure of the expanding gasses within the combustion chambers. The valves 80 can be poppet valves as are used in standard contemporary gasoline engines. This single valve configuration can be advantageous over separate intake and exhaust valves because it achieves greater volumetric efficiency, simplifies the cam geometry, enables less energy to be spent depressing the valve only once during each four cycle operation, and reduces the need for rapid acceleration of the valve stroke as is necessary in a two valve configuration. Nonetheless, it is intended that the spirit and scope of this invention extend to an embodiment with separate intake and exhaust valves and actuation thereof. Each valve 80 includes a stem 86 operatively connected to a proximal end of the valve lifter 81 via the valve return spring 82 which biases the valve 80 in a closed position. The retainer 84 keeps the tracking roller 83 engaged to a distant end of the valve lifter 81. The tracking roller 83 is positioned at the upper surface 72 of the head unit and engages the cam assembly 68 for moving the valve 80 up and down and thereby controlling the closing and opening of the intake port 62 and exhaust port 64 of respective cylinders 46.

The cam assembly 68 includes a cam plate 90 adjacent the upper surface 72 of the head unit 60 and having a plurality of cam surfaces 92 protruding therefrom, or other mechanical actuator which controls the valves 80, so as to open each valve 80 commencing at the exhaust stroke (about 540° to about 720°) and remain open through the intake stroke (about 0° to about 180°) and so as to close each valve 80 commencing at the compression stroke (about 180° to about 360°) and remaining closed throughout the power stroke (about 360° to about 540°). It can be advantageous to use an odd number of pistons 54 and corresponding cylinders 46 so that every other piston 54 continuously fires while the cylinder bank assembly 12 is rotating in normal four-cycle operation. The cam plate 90 has an internal gear 94 that engages an external gear 96 on the rotating cylinder bank assembly 12 at one position as shown in FIGS. 1 and 2. The cam plate 90 is rotatably mounted to the stationary housing 11 about a cam axis 98 such as by bearings 44 and 45. The cam axis 98 is essentially parallel to the central longitudinal axis 42 and radially offset outwardly from it in the direction corresponding to bottom dead center of each piston 54 in its corresponding cylinder 46. This offset can be determined by the difference in the radius of the gears 94 and 96 on the spinning cam plate 90 and the rotating cylinder bank assembly 12, respectively. The cam plate 90 spins at an exact synchronous ratio to the cylinder bank assembly 12 so that the cam surfaces 92 are timed to actuate the valves 80 according to the particular timing sequence of the engine 10. Cam surfaces 92 can be similar to cam surfaces described in U.S. Patent Application 20030131807 entitled "Rotating Positive Displacement Engine", and published Jul. 17, 2003, incorporated herein by reference in its entirety.

Figure 17:
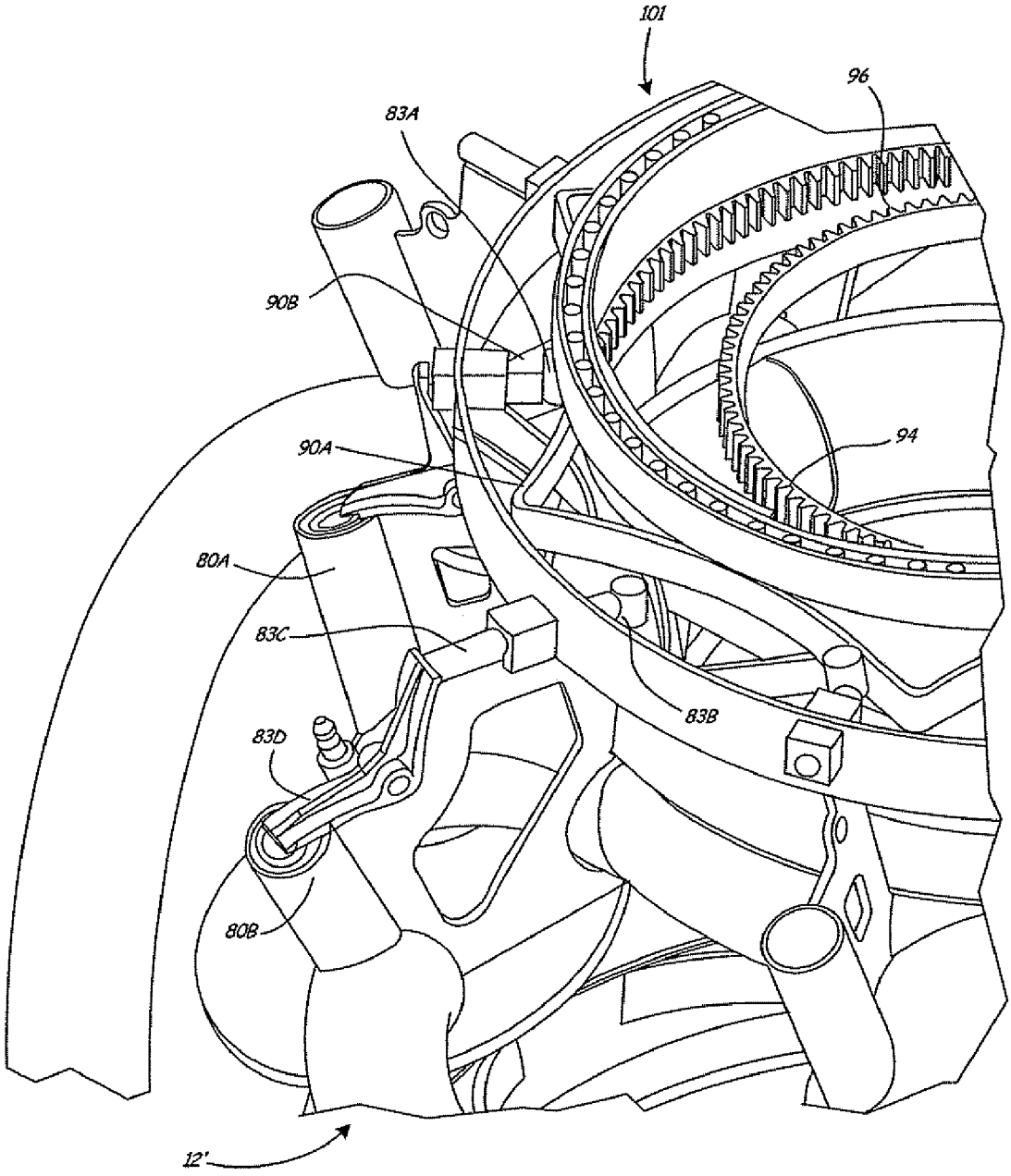
FIG. 17 is a perspective view of a portion of a third embodiment of a rotating barrel engine with parts removed.
Figure 18:
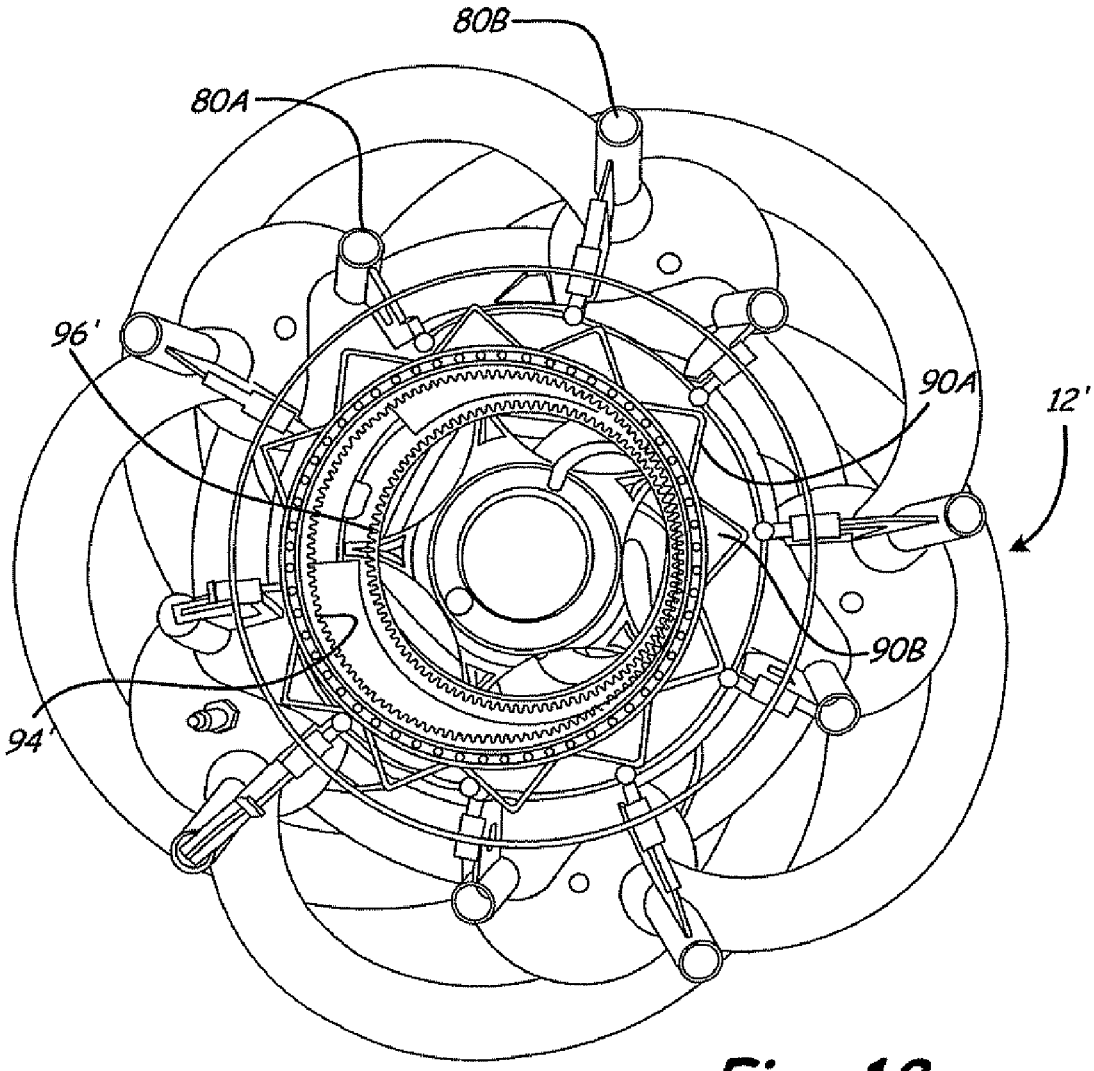
FIG. 18 is a top plan view of the third embodiment of the rotating barrel engine with parts removed.

In the illustrated example of a seven-cylinder engine, it is preferred that the cam plate 90 rotate slower than the cylinder bank assembly 12 so that the cam plate 90 advances seven rotations for every eight rotations of the cylinder bank assembly. The seven-to-eight gear ratio causes each valve 80 to be opened only for the desired fuel exhaust and intake cycles of the engine 10, and to remain closed for the compression and power cycles of the engine 10. In this arrangement there is provided four protruding cam surfaces 92 on the cam plate 90. The profile of the cam surfaces 92 as well as the area between the cam surfaces 92 are shaped so that with the seven-to-eight gear ratio of the cam plate 90 to cylinder bank assembly 12 and with the axial offset therefrom, the cam surfaces 92 uniformly contact and stay in uniform contact with all of the tracking rollers 83 as the cylinder bank assembly 12 rotates. Depression of the tracking roller 83 by the cam surfaces 92 thereby depresses the respective valve lifer 81 and corresponding valve 80 as the engine rotates, so that each valve 80 is depressed only one time for a period of approximately 360° in every two rotations (720°) of the cylinder bank. The valve return spring 82 returns the valve 80 to the closed position after the cam surface 92 moves past the tracking roller 83. For other design embodiments involving a different odd number of cylinders 46 (for example 1, 3, 5, 9, 11, etc.) and a different number of valves 80 per cylinder 46 (for example 1, 2, 3, 4, etc.) there will be a different timing ratio and a different number of cam surfaces 92 on the cam plate 90. For example, FIGS. 17 and 18 illustrate a five cylinder engine 10' having two valves per cylinder (intake valve 80A and exhaust valve SOB) and two cam plates (intake valve cam plate 90A and exhaust valve cam plate 90B) offset with respect to each other to actuate an intake valve 80A and an exhaust valve 80B, respectively. In such an arrangement, each of the two cam plates 90A, 90B would spin slower than the cylinder bank 12' at a ratio of 5/6 its speed and there would be six cam surfaces on each cam plate 90A, 90B so that each respective intake valve 80A and exhaust valve BOB is actuated along each of the respective cam surfaces during the course of six revolutions of the cylinder bank 12'. In this embodiment, each valve 80A, 80B is operated through a roller 83A, 83B that contacts the corresponding cam plate 90A, 90B. Each roller 83A, 83B is supported on a push rod 83C that in turn actuates a rocker 83D that operates the corresponding valve BOA, SOB. In this case the contact speed of each roller 83A, 83B to the corresponding cam plate 90A, 90B is ⅙ the engine speed. Referring to the embodiments of FIGS. 1-2 and 17-18, while it is possible to spin the cam plate 90, 90A, 90B faster than the cylinder bank assembly 12, 12' and achieve proper synchronization, it is advantageous to spin the cam plate 90, 90A, 90B at a slower speed to minimize impact of the tracking rollers 83, 83A, 83B against the corresponding cam surfaces. It should also be noted with regard to FIGS. 17 and 18 that the cam surfaces may be located on the lateral edge of the generally flat star-shaped cam plate 90A, 90B, and as such the flat cam plates 90A, 90B are more easily machined than the cam plate 90 shown in FIG. 1. The cam plates 90A, 90B (which can be formed from an integral unitary body) include gear teeth 94' that mate with a drive gear 96' that rotates with the cylinder bank 12'.

As described above, conventional rollers 83A, 83B moving along the lateral or perimeter edge cam surface actuate conventional rockers 83D, lifters and springs to open and close the corresponding valves 80A, 80B. In should be noted that the star-shaped cam plates 90A, 90B shown in FIGS. 17 and 18 appear as flat surfaces to the rollers 83A, 83B and that identical cam lobes (not shown) would be positioned on each lateral edge of the six-sided star-shaped intake cam plate 90A, and another set of identical cam lobes (not shown) would be positioned on each lateral edge of the exhaust cam plate 908. The cam lobes are not shown because their position is determined by the desired valve timing. Referring back to the exemplary embodiment of FIGS. 1-2, the air delivery system 20 includes a primary air compressor 102 and a secondary air compressor 104 and is used to cool the engine 10 and to compress or supercharge the fuel-air mix for increased combustion. The primary air compressor 102 is rotatably mounted via bearings on a first drive shaft 106 which is substantially aligned with the central longitudinal axis 42 and the secondary air compressor 104 is rotatably mounted on a second drive shaft 108 which is concentric within the first drive shaft 106. An inner end 109 of the second drive shaft 108 is rotatably mounted to the cylinder carriage 52 for support. The primary and secondary air compressors 102 and 104 spin independently at different speeds with respect to each other and at a substantially greater rate than the cylinder bank assembly 12. The primary and secondary air compressors 102 and 104 are driven by any one of a variety of methods including a gear train (not shown) directly linked to the rotating cylinder bank assembly 12. The air compressors 102 and 104 can also be driven by variable speed electric motors 110 and 111 (FIG. 2), respectively, which transfer power either directly or through a power train. The speed of the electric motors 110 and 111 is variable and governed by a control unit 112 via a connection line so as to control the pressure and volume of air provided to the engine 10 in proportion to the needs of varying operating engine conditions such as load, rpm, temperature, acceleration, etc.

Figure 3:
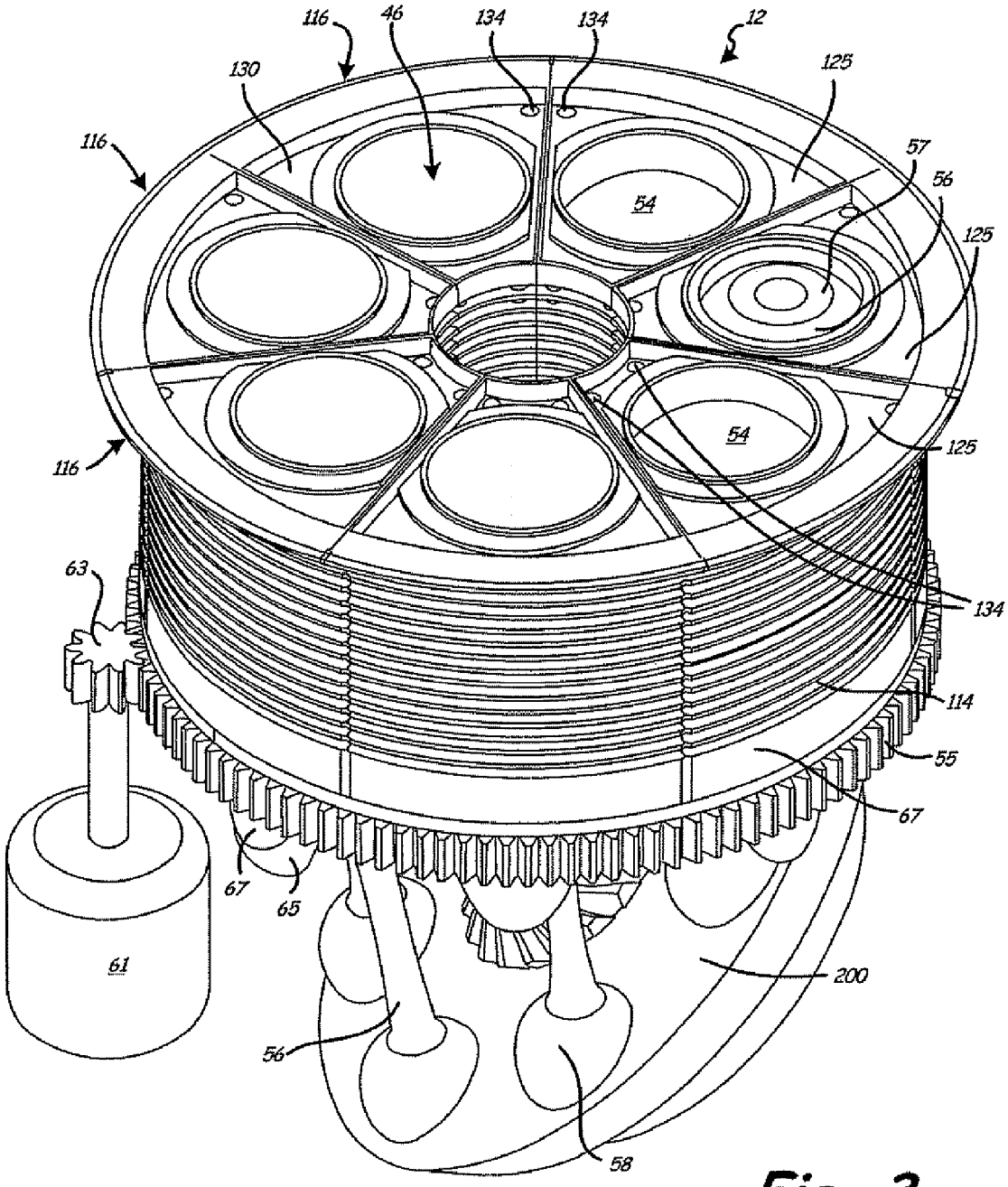
FIG. 3 is a perspective view of a cylinder bank and thrust plate assembly.
Figure 4:
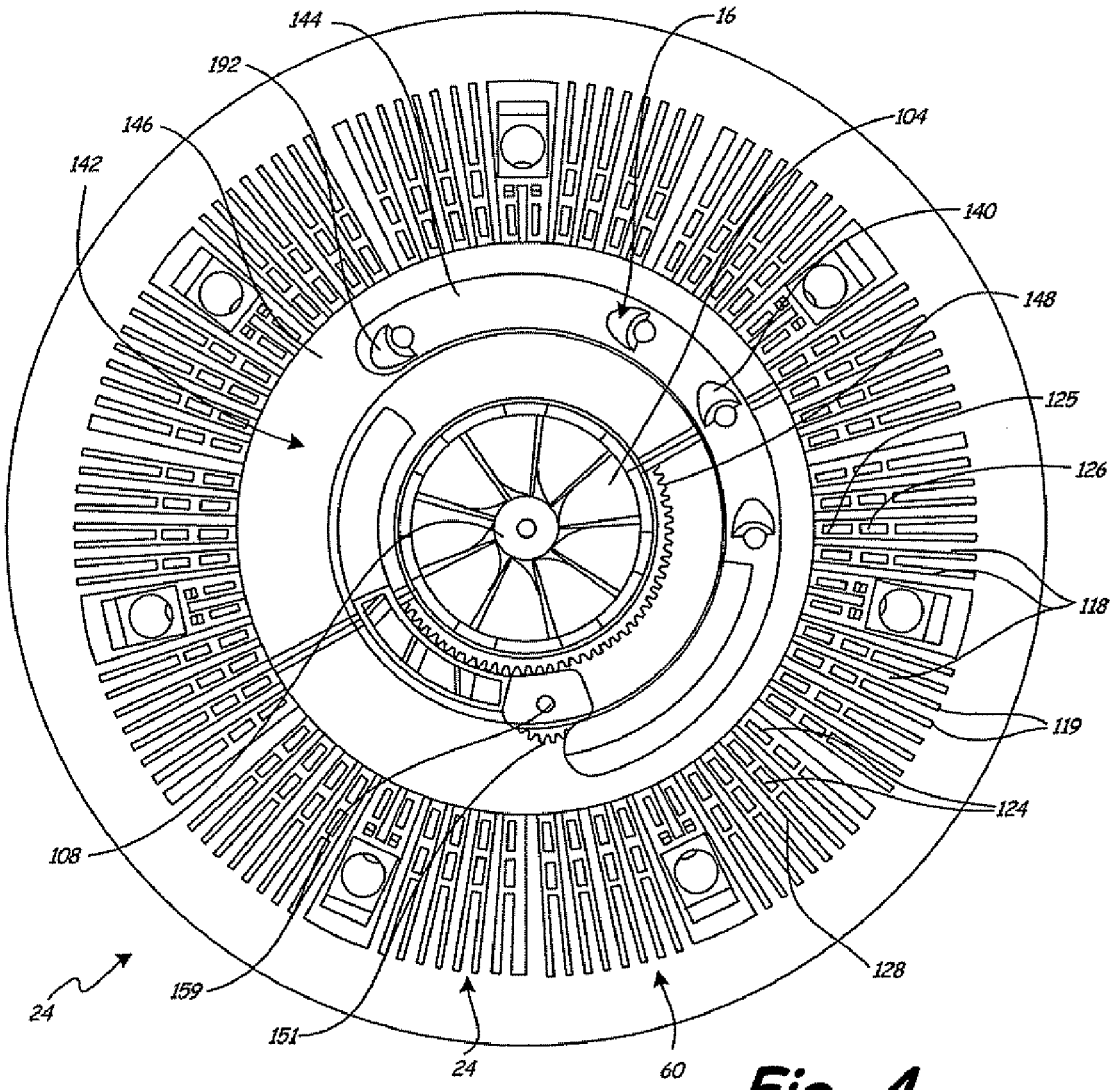
FIG. 4 is a sectional view of the rotating barrel engine of FIG. 2 taken along lines 4-4.

The engine conditions are monitored through the use of dedicated real time sensors (not shown), which are well known in the art, for measuring conditions such as rpm, load, throttle position, cylinder temperature, head temperature, air velocity, exhaust composition, and manual override, etc. However, it may be desirable to use optical or radio frequency transmission for sensors which are placed on-board the rotating cylinder bank. One of the uses for the compressed air can be to cool the cylinders 46 and the head unit 60. As shown in FIG. 3, in regard to the cylinders 46, the cylinder walls 49 have a plurality of cooling fins 114 extending out therefrom in a respective plurality of planes each of which are substantially perpendicular to the central longitudinal axis 42 and are cut to form a lateral wedge-shaped cooling fin arrangement 116 which communicates with the lateral wedge-shaped cooling fin arrangements 116 of adjacent cylinders 46 to provide maximum heat transfer surface area. The cylinder carriage 52 acts as a baffle directing pressurized air flowing down the center of the engine 10 out across the cylinder cooling fins 114. Referring to FIGS. 2 and 4, in regard to the head unit 60 a plurality of cooling slots 118 are located on the inner surface 70 thereof and a plurality of cooling fins 119 arranged on the outer surface 71 thereof. Ambient air flows axially and radiates downwards from the air intake port in the primary air compressor 102 towards the circumference of a stationary compressor shroud 120 by action of compressor impellers 122 and thereby becomes pressurized for entering the rotating head unit 60 where it is then directed through the plurality of cooling slots 118 and across the cooling fins 119 for cooling the head unit 60. A portion of the pressurized air passes down through the center of the cylinder head 60 and into the fuel delivery assembly 16 where it is further pressurized by the secondary air compressor 104. A first portion of this further compressed air then passes through an opening 117 (see FIG. 5) below the secondary air compressor 104 and into the lateral wedge-shaped cooling fin arrangements 116 for cooling the cylinders 46 as described above. A second portion of this further compressed air is directed into the fuel delivery system 16 to create an air-fuel mixture and then into the plurality of cylinders 46 for combustion. Alternatively, this second portion of further compressed air may be delivered into the plurality of cylinders 46 without the fuel so as to provide compression resistance within the cylinders to slow the engine speed. A third portion of this further compressed air is used in the scavenging system 18. A fourth portion of this further compressed air is used to back pressure the combustion exhaust manifold 30 via back pressure passageway 40.

Referring to FIGS. 2-4, the liquid cooling system 24 provides added cooling of the cylinder bank assembly 12 by way of least one closed-loop passageway 124 self contained within the cylinder bank assembly 12, wherein each passageway 124 has a hot area 125 and a cooler area 126A; and a heat expansive liquid contained within the closed-loop passageway 124 for transferring heat from the hot area 125 to the cooler area 126A as the cylinder bank assembly 12 rotates. More specifically, the head unit 60 further includes a plurality of closed loop passageways 124 therein, each passageway 124 having a hot area 125 adjacent the valve 80 and a cooler area 126A distant to the valve 80. The heat expansive liquid within the passageway 124 transfers heat from the hot area 125 to the cooler area 126A along a toroidal path as the head unit 60 rotates. The liquid flow is caused via a centripetal force acting on the heat expansive liquid as it becomes less dense moving to the hotter area 125. The centripetal force caused by the rotating head unit 60 causes this more dense material to move outward from the heat source thereby effectively transferring the heat. The cooler area 126A of the passageway 124 slopes towards a perimeter of the head unit 60 and the hotter area 125 of the passageway 124 slopes towards an interior of the head unit 60 to create a toroidal flow within the passageways 124. The cooling fins 119 of the head unit 60 extend radially out from the side walls of the cooler area 126A of the passageways 124, The cooling slots 118 (FIG. 4) of the head unit 60 are positioned between each passageway 124 so that cooling air passes across the cooling fins 119. Holes 128 (FIG. 4) in each of the cooling fins 119 permits air to flow between all of the cooling fins 119 for added air circulation. Cooling air from the primary air compressor 102 passes through cooling slots 118, moves across the side walls of the passageways 124 and then across and between the cooling fins 119 to provide cooling of the head unit 60.

In addition or in the alternative to passageways 124 described above, each of the plurality of cylinders 46 can also have at least one closed-loop passageway 134 self contained adjacent the cylinders walls 49 of each of the plurality of cylinders 46. Each of the closed-loop passageways 134 is adjacent hot area 125 and has a cooler area 126B; and a heat expansive liquid contained within the closed-loop passageway 134 for transferring heat from the hot area 125 to the cooler area 126B as the cylinder bank assembly 12 rotates. More specifically, each cylinder 46 further includes an upper chamber 130 adjacent to the upper end 47 of the cylinder 46 acting as the hot area 125, a lower chamber 132 adjacent to the lower end 48 of the cylinder 46 acting as the cooler area 126B, and a plurality of tubular passageways 134 connecting the upper chamber 130 to the lower chamber 132 so that the heat expansive liquid flows in a toroidal manner from the cooler areas 126B to the hotter areas 125 and vice versa. The tubular passageways 134 are angled so that the heat expansive liquid within the passageway 134 transfers heat from the hot area 125 near the valve 80 to the cooler area 136 at the distant radius of the lower end 48 of the cylinder 46. An oblique angle of the tubular passageways 134 allows the centripetal force to move the colder more dense liquid at the lower end 48 of the cylinders 46 upwards towards the periphery of the cylinder bank and the valve 80 where it then becomes hotter and less dense so that it then moves inwards towards the center of the cylinder bank causing a toroidal flow effectively transferring heat and cooling the cylinders 46. The cylinder cooling fins 114 extend across an exterior surface of the tubular passageways 134 so that cooling air from the primary and secondary compressors 102 and 104 passes over the exterior surface of the passageways and across the cooling fins 114 to cool the cylinders 46. Cylinder cooling fins 114 also extend out from the cylinder wall 49 within the upper chamber 130 and within the lower chamber 132 to aid in heat transfer. It is desirable to connect the closed-loop passageways 124 between the head unit 60 and the cylinders 46 to each other to further aid in cooling. The closed-loop liquid cooling system 24 described herein is desirable because it does not require any external energy source other than the rotating motion of the cylinder bank assembly 12. In addition, because the system 24 is self-contained within the rotating cylinder bank assembly 12 sliding seals and additional bearings are not needed as would be the case if the cooling liquid is pumped in from an external radiator. Nonetheless, it may be desirable or required to pump the heat expansive liquid to an external radiator to increase the volume of the fluid flow and provide adequate heat transfer.

Figure 5:
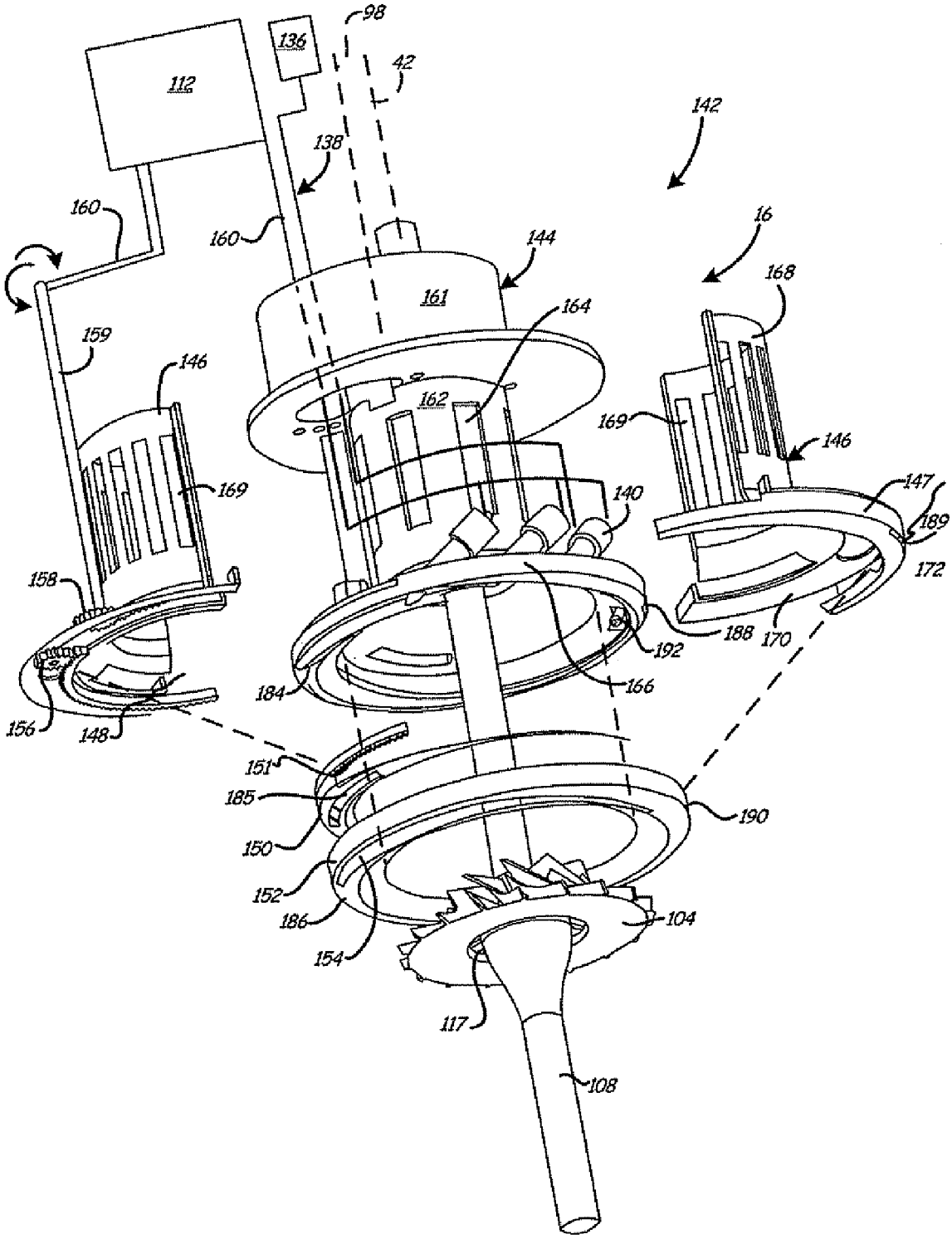
FIG. 5 is an exploded view of a fuel supply system.

Referring to FIGS. 2 and 5, the fuel delivery system 16 includes a fuel supply unit 136, one or more fuel lines 138 which extend from the fuel supply unit 136 and pass through a portion of the stationary housing 11, a series of liquid fuel injectors 140 connected thereto for mixing and admitting atomized liquid fuel to the pressurized air, and a throttle 142 for controlling the amount of fuel/air mixture that is admitted to the cylinders 46. The control unit 112 regulates the amount of fuel admitted to the fuel injectors 140 as well as the operation of the throttle 142 and the speed of the air compressors 102 and 104. The fuel injectors 140 are of the common rail type and are well known in the art. The throttle 142, on the other hand, includes a stationary throttle support 144 fixedly mounted to the stationary housing 11, an actuator 146 having a first arc-shaped door 147 and an actuator gear 148 thereon, a second arc-shaped door 150 having an actuator gear 151 thereon, a cylinder head interface barrier 152 rigidly attached to the stationary throttle support 144 for providing the interface between the first and second doors 147 and 150 and the intake ports 62 of the cylinders 46 and for providing a fuel administration opening 154 therethrough, a synchronizing pinion gear 156 rotatably mounted to the stationary throttle support 144 for simultaneously moving the first and second throttle doors 147 and 150 either away from each other to increase flow through the fuel administration opening 154 or towards each other to decrease flow through the fuel administration opening 154, an actuator pinion gear 158 rotatably mounted to the stationary throttle support 144 for engaging the actuator gear 151, and a control unit 112 which controls the actuator pinion gear 151 through a rod 159 via line 160.

The stationary throttle support 144 includes a head portion 161 which provides the offset for the cam axis 98, a neck portion 162 which has a plurality of cooling slots 164 thereon for directing pressurized air from the primary air compressor 102 to the head unit 60, and a base portion 166 into which the stationary fuel injectors 140 are fixedly mounted so as to admit atomized fuel into a stream of air moving into each of the plurality of the cylinders 46 during the intake stroke thereof, for example, in sequence as cylinders pass by on their respective intake stroke. The actuator 146 is constructed in two pieces so as to be rotatably mounted around the neck portion 162 of the stationary throttle support 144 about the central longitudinal axis 42. The actuator 146 includes a neck portion 168 having a plurality of cooling slots 169 thereon for directing pressurized air passing through the cooling slots 164 of the neck portion 162 of the stationary throttle support 144 to the head unit 60 for cooling thereof, and a base portion 170 having an opening 172 allowing the actuator 146 to rotate around the stationary fuel injectors 140. The first door 147 extends outward from an underside of the base portion 170 in an arc shape and circumferentially moves with respect to the arc shaped second door 150 through the pinion gear 156 so as to open and close an arc shaped opening along the entire circumferential arc forming the intake stroke. It is important to note that the arc shaped opening exposed by circumferential movement of the throttle doors 147 and 150 can be increased or decreased both radially and along a circumferential arc defined by the intake cycle, thereby providing maximum control in delivering air and air-fuel mixture to the cylinders 46. In the case of an engine 10 having seven or more cylinder, the throttle simultaneously delivers air and air-fuel mixture to at least two open cylinders 46 during the entire intake cycle.

Figure 19:
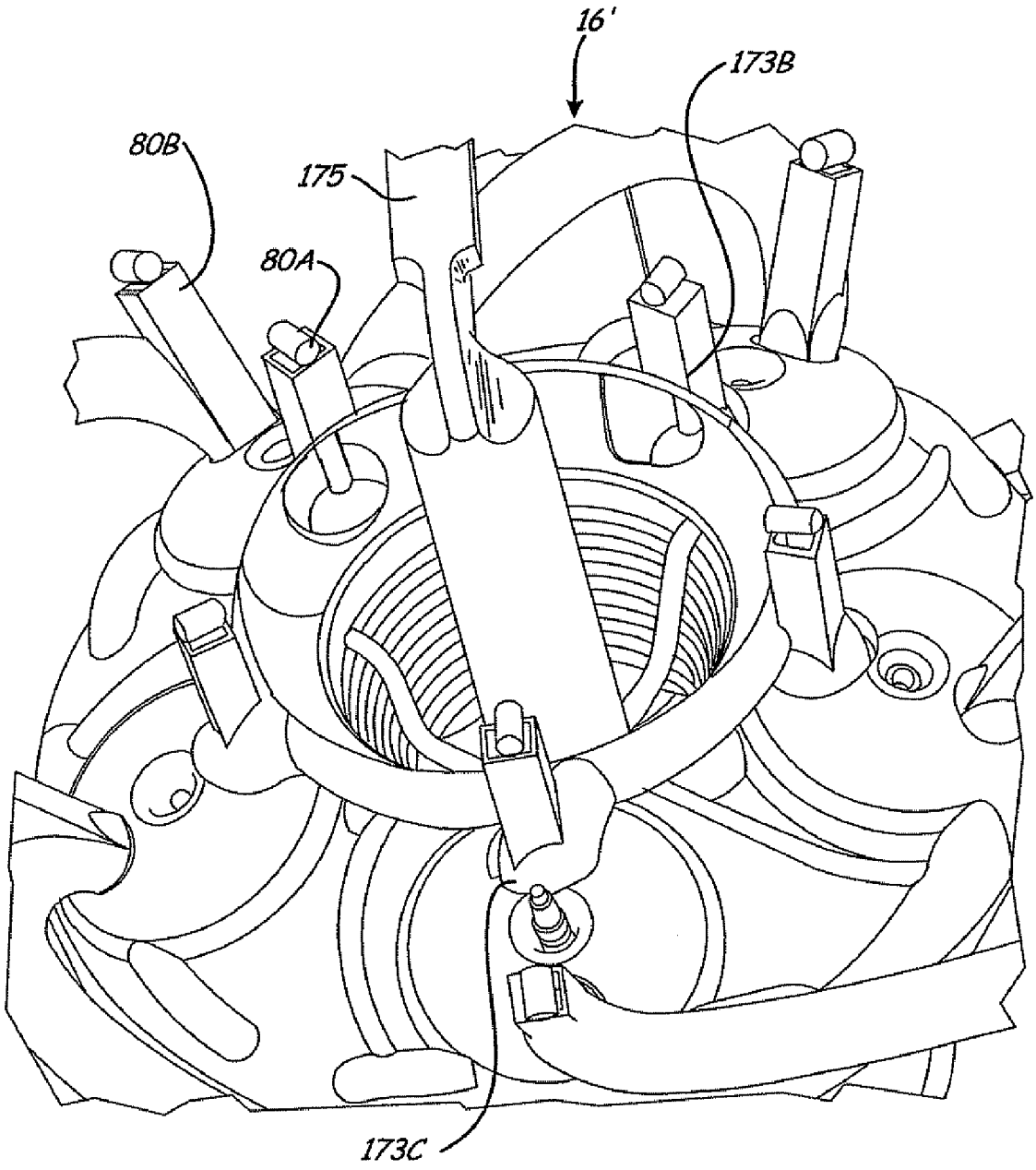
FIG. 19 is a perspective view of an intake manifold with parts removed.
Figure 20:
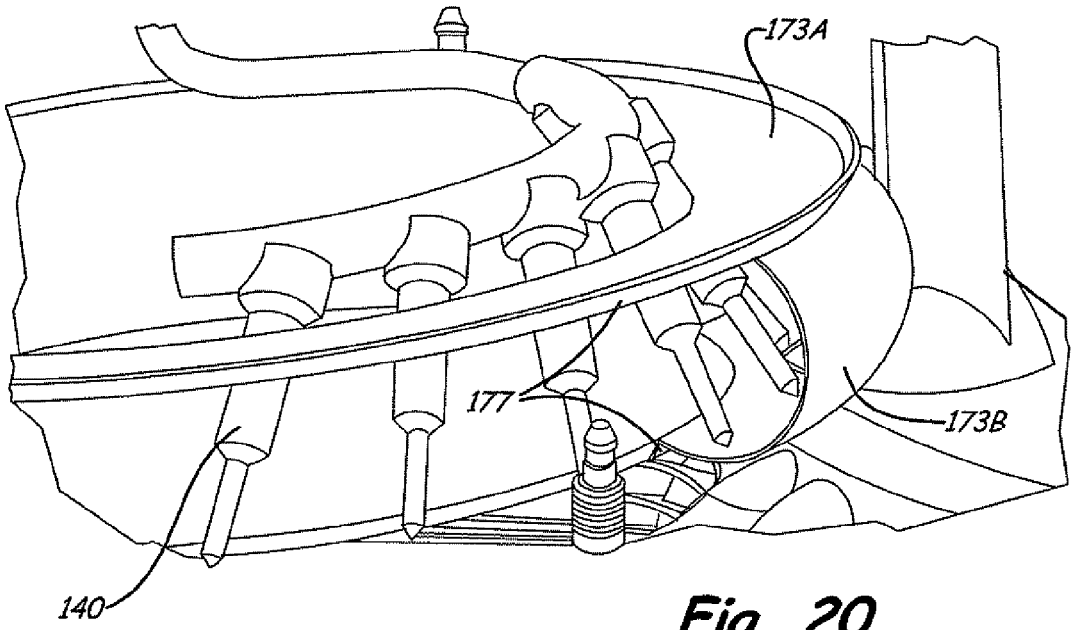
FIG. 20 is a perspective view of the intake manifold with parts removed.
Figure 21:
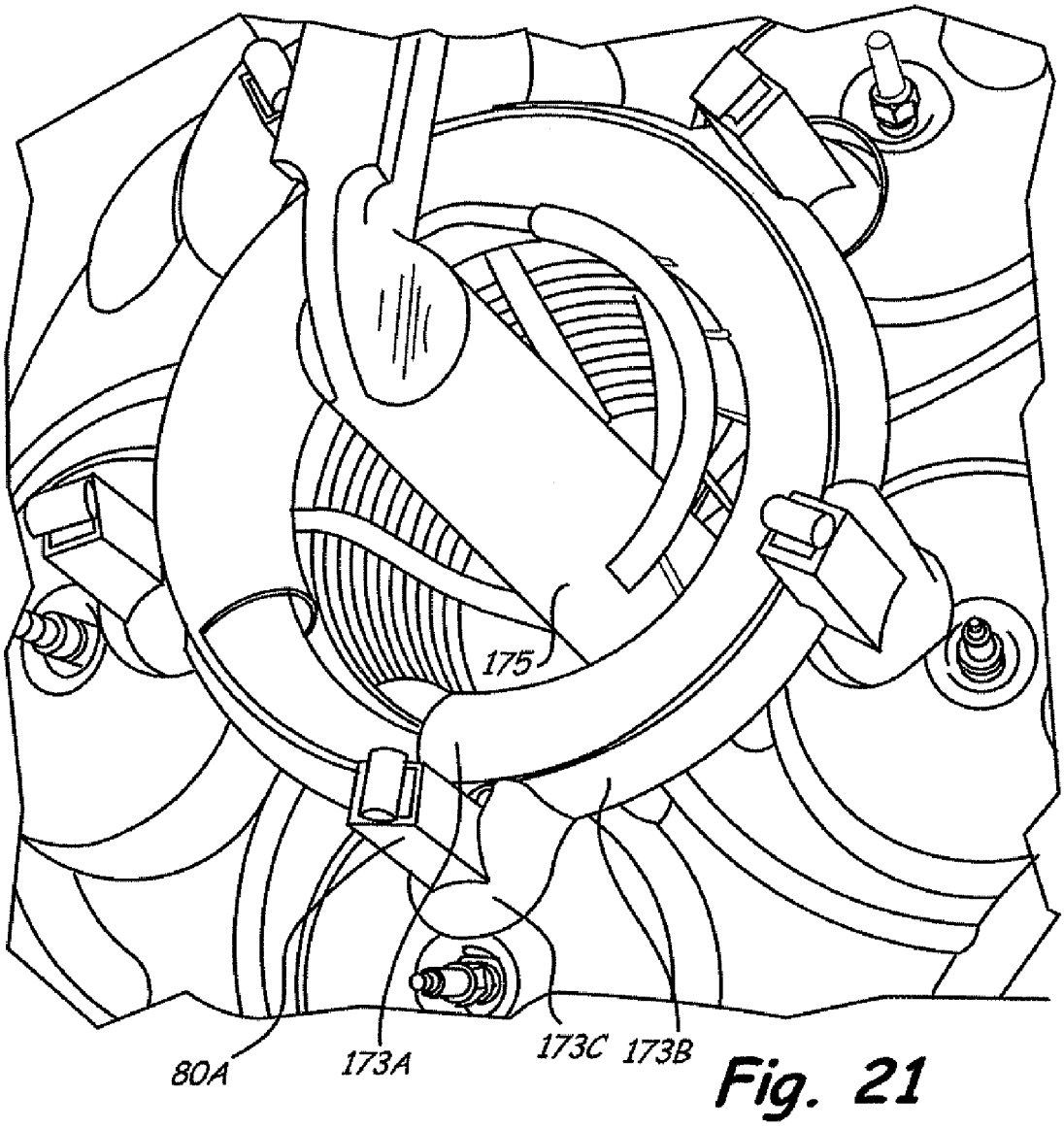
FIG. 21 is a perspective view of the intake manifold with parts removed.

FIGS. 19-21 illustrate an alternative fuel delivery system 16' in which there is a stationary semi circular manifold 173A mounted to the stationary housing represented by support shaft 175 for example with spokes not shown, and a rotating semi-circular manifold 173B mounted to the rotating cylinder bank 12' and which nests with the stationary semi circular manifold 173A. The stationary manifold 173A is only exposed on the intake side of the engine and is closed off on the exhaust side. The rotating manifold 173B includes separate runners or passageways 173C leading to each of the intake valves 80A of the cylinders. In FIG. 20, common rail fuel injectors 140 are positioned in the stationary semicircular manifold 173A and controlled as described above so that a controlled amount of fuel is delivered to the cylinders. Seals 177 are used between the stationary manifold 173A and the rotating manifold 173B to prevent escape of the fuel air mixture and it may be desirable to use a small blower to back pressure the seals.

Referring to FIG. 2, the ignition system 22 includes a plurality of spark plugs 174 arranged singular or in pairs on both sides of the valve 80 associated with each cylinder 46, a pair of spark plug contact strips 176 connected to each of the spark plugs 174 within each cylinder 46, a spark plug commutator 178 mounted to the stationary housing assembly 11 so as to operate in contact with the spark plug contact strips 176 as the head unit 60 rotates, and the control unit 112 for providing the desired ignition timing and sequence. The fuel delivery system 22 admits a fuel and air mixture in a timed sequence into each cylinder 46 via its intake port 62 as the piston 54 therein moves from an up position to a down position as the cylinder bank assembly 12 rotates. The fuel/air mixture is then compressed within the cylinder 46 as the piston 54 therein moves from the down position to the up position as the cylinder bank assembly 12 rotates, and then the control unit 112 ignites the fuel/air mixtures in timed sequence as the spark plugs in each cylinder operatively engages the spark plug commutator at some point before top dead center so that the flame kernel can fully develop when the piston has maximum mechanical advantage. The spark plug contact strips 176 have independent metal contact strips connected to each of the spark plugs 174 for independently and simultaneously firing both spark plugs 174 within each cylinder 46. The relatively slow formation of the initial flame kernel and the subsequent burn produces a peak cylinder pressure after top dead center. The explosion drives the respective piston 54 from the up position to the down position and causes the power take off assembly to rotate thereby creating torque. The combusted gases within the cylinder 46 are exhausted through the exhaust port 64 thereof and into the combustion exhaust manifold 30 as the piston moves from the down position to the up position. In order to achieve the four-cycle operation, it is preferred that there is an odd number (1, 3, 5, 7, 9, etc.) of combustion chambers so that as the cylinder bank assembly 12 rotates, each cylinder 46 goes through the four-cycle operation in a simple timed sequence wherein every other cylinder 46 is acted upon. More specifically, on one side of the engine 10 adjacent cylinders 46 alternate between the intake and power cycles, wherein the control unit 112 times the spark plugs 174 so as to fire in every other cylinder 46 as the cylinder bank assembly 12 rotates, and wherein the fuel control assembly 14 admits a fuel and air mixture to every other cylinder 46 as the cylinder bank assembly 12 rotates. On the other side of the engine 10, the adjacent cylinders alternate between the compression and exhaust cycles. In the seven cylinder engine, this alternate firing/fueling and, conversely, compression/exhaust provides continuous operation and accomplishes the four-cycle operation for all of the cylinders 46 in the course of two full rotations of the cylinder bank assembly 12 in the following sequence: Cylinder #1, #3, #5, #7, #2, #4, #6, #1, etc.

Referring to FIG. 6, the scavenging system 18 is provided to minimize emissions and maximize efficiency of the engine. The scavenging system 18 includes a pre-exhaust scavenging system 180 which scavenges any residual fuel which gets trapped in the cylinder intake ports 62 and exhaust ports 64 after the valve 80 closes so as not to leak unburned fuel into the combustion exhaust manifold 30, and a post exhaust scavenging system 182 to scavenge any residual combustion exhaust out of the cylinders 46 before commencing the intake stroke. The pre-exhaust scavenging system 180 operates on each and every intake and exhaust port 62 and 64 at approximately bottom dead center when the cam assembly 68 is transitioning the valves 80 from closed to open (to commence the exhaust stroke) or from open to closed (to commence the compression stroke). At bottom dead center all valves 80 are closed which is just before a leading edge of one cam surface 92 opens a valve 80 whose cylinder 46 is about to start exhaust and just after a trailing edge of an adjacent cam surface 92 falls off causing the adjacent valve 80 to close after the intake stroke. Air from the secondary air compressor 104 is bled off through a pre-exhaust scavenging opening 184 in the stationary throttle support 144, through a pre-exhaust scavenging opening 185 in the second throttle door 150, through a pre-exhaust scavenging opening 186 in the cylinder head interface barrier 152, through the intake and exhaust ports 62 and 64 for scavenging, out into the stationary pre-exhaust scavenging manifold 36 which directs the scavenging gases up, around and down through the stationary throttle support 144 so as to recycle the scavenged gases into the secondary air compressor 104 adjacent to the intake ports 62 for charging the cylinders 46 during the intake stroke. The post exhaust scavenging system 182 also operates with respect to each and every cylinder 46 except that some valves 80 are open and some are closed depending on whether the cylinder 46 is ready to transition from the compression stroke or the exhaust stroke. The post exhaust scavenging system 182 is portioned adjacent top dead center when the valve 80 of cylinders 46 in the exhaust stroke is still open and when the exhaust port 64 is out of communication with the combustion exhaust manifold 30, before the intake ports 62 are exposed for charging of the cylinders 46. With respect to closed valve cylinders 46, air from the secondary air compressor 104 is bled off through a post exhaust scavenging opening 188 in the stationary throttle support 144, through a post exhaust scavenging opening 189 in the first throttle door 147, through a post exhaust scavenging opening 190 in the cylinder head interface barrier 152, through the cylinder intake and exhaust ports 62 and 64 for scavenging, out into a stationary post-exhaust scavenging manifold 37 which directs the scavenging gases up, around and down through the stationary throttle support 144 so as to recycle the scavenged gases with the pre-exhaust scavenged gases and into the secondary air compressor 104 adjacent to the intake ports for charging the cylinders during the intake stroke. With respect to open valve cylinders 46, air from the secondary air compressor 104 passes through post exhaust scavenging openings 188, 189 and 190, through the cylinder intake port 62, into the cylinders 46 where it swirls down and then out through the exhaust port 64 scavenging any residual combustion exhaust gases into a stationary post-exhaust scavenging manifold 37 as indicated above.

Referring to FIGS. 5 and 6, a water injector 192 may be provided for added cooling of the valve 80 on demand. The water injector 192 is mounted into the stationary throttle support 144 and positioned adjacent to the post exhaust scavenging opening 188 for squirting atomized water directly onto the valve 80 for added cooling, if needed, and for adding to the density of the scavenged gases which enter the stationary post-exhaust scavenging manifold 37. The water injector 192 is connected to the control unit 112 via line 193 so as be activated as engine conditions demand.

Referring to FIGS. 1 and 2, in its simplest form the power take off assembly 14 includes a load bearing thrust plate 200 having a synchronizing gear 202 thereon, a stationary thrust housing plate 204, primary thrust bearing 206, a centering bearing 208, and a power take off shaft 210 fixedly mounted to an underside of the thrust plate 200 along a thrust axis 212 which intersects the central longitudinal axis 42. The thrust plate 200 revolves in a thrust plane around the thrust axis 212 and is supported against the thrust housing plate 204 by the primary thrust bearing 206 which is positioned against a flange 214 extending from an underside of the thrust plate 200. The centering bearing 208 is positioned around the power take off shaft 210 adjacent a flange 216 extending from an underside of the thrust plate 200. The thrust plate 200 is tilted at a fixed oblique angle to a plane which is perpendicular to the central longitudinal axis 42 which is between 0° and 90° degrees. The synchronizing gear 202 or other synchronizing mechanism is positioned on the thrust axis 212 at the center of the thrust plate 200 for interfacing with the synchronizing gear 53 extending from the cylinder carriage 52 for transferring torque therethrough and for synchronizing the thrust plate 200 and cylinder bank assembly 12 in a one-to-one rotational relationship at the fixed oblique angle, which can be approximately 45° to maximize the long axis of the oval trajectory and hence the torque. Adjusting other parameters to maximize torque may result in an actual optimal range of the thrust plate angle between 35° and 75°. The thrust plate 200 supports the outer ends 58 of all the connecting rods 56 which are cardan joints with a preferable double universal joint or a spherical rotatable ball joint mounted thereto via retainers 218. The thrust plate 200 directs the connecting rods 56 on a circular course in unison with the pistons 54 as the cylinder bank assembly 12 rotates. Since the thrust plate 200 is at an oblique angle to a plane perpendicular to the central longitudinal axis 42 and since the pistons 54 are linked to the thrust plate 200 by the connecting rods 56, the pistons 54 are forced to travel between an up most position within the cylinder which is top dead center (TDC) and a down most position within the cylinder which is bottom dead center (BDC) as they rotate about the central longitudinal axis 42. When the major axes of the cylinders are arranged parallel to the central longitudinal axis, then TDC is at 0° of thrust plate rotation and BDC is at 180° of thrust plate rotation. In this arrangement, at TDC the major cylinder axis, the connecting rod and the central longitudinal axis lie in the same plane. In this configuration, it is not practical to advance the thrust plate more than a few degrees because the rod will clash with the cylinder wall as the system rotates.

As evident from FIGS. 1 and 2, increasing the oblique angle which the thrust plate 200 makes with the plane perpendicular to the central longitudinal axis 42 would cause the cubic displacement in the combustion chamber of the cylinder 46 to increase to a maximum defined by the stroke, which is the distance that the piston 54 travels within the cylinder 46 as the rotation of the cylinder bank assembly 12 advances from TDC to BDC, and which is defined by the radius of the circular trajectory of the centers of the outer ends 58 of the connecting rods 56 as they travel about thrust axis 212. Since the pistons 54 are linked to the thrust plate 200 by connecting rods 56, the bottom of the rods are thus made to follow a circular trajectory with respect to the thrust axis 212. This circular trajectory forms an oval trajectory both with respect to a plane perpendicular to the central longitudinal axis 42 and with respect to a plane which is parallel to the central longitudinal axis 42. As the cylinder bank assembly 12 rotates it becomes possible to cause the pistons 54 to effectively dwell near the top of its respective cylinder thereby increasing the heat and pressure forces acting on the pistons 54 and significantly improving the thermal efficiencies of combustion. As used herein, "dwell" refers to a substantially non-sinusoidal piston movement with respect to its corresponding cylinder and rotation of the output shaft. In particular, piston movement is substantially reduced at the top of the cylinder in spite of rotation of the output shaft. This allows combustion of the fuel/air mixture to occur when the volume of the cylinder above the piston is substantially constant, which improves thermal efficiency. Another potential advantage of the pistons 54 being linked to the thrust plate 200 in this way is that the dwell lessens the inertia of the pistons 54 as they reciprocate within the cylinder thereby, in effect, further increasing overall performance of the engine 10.

Figure 8:
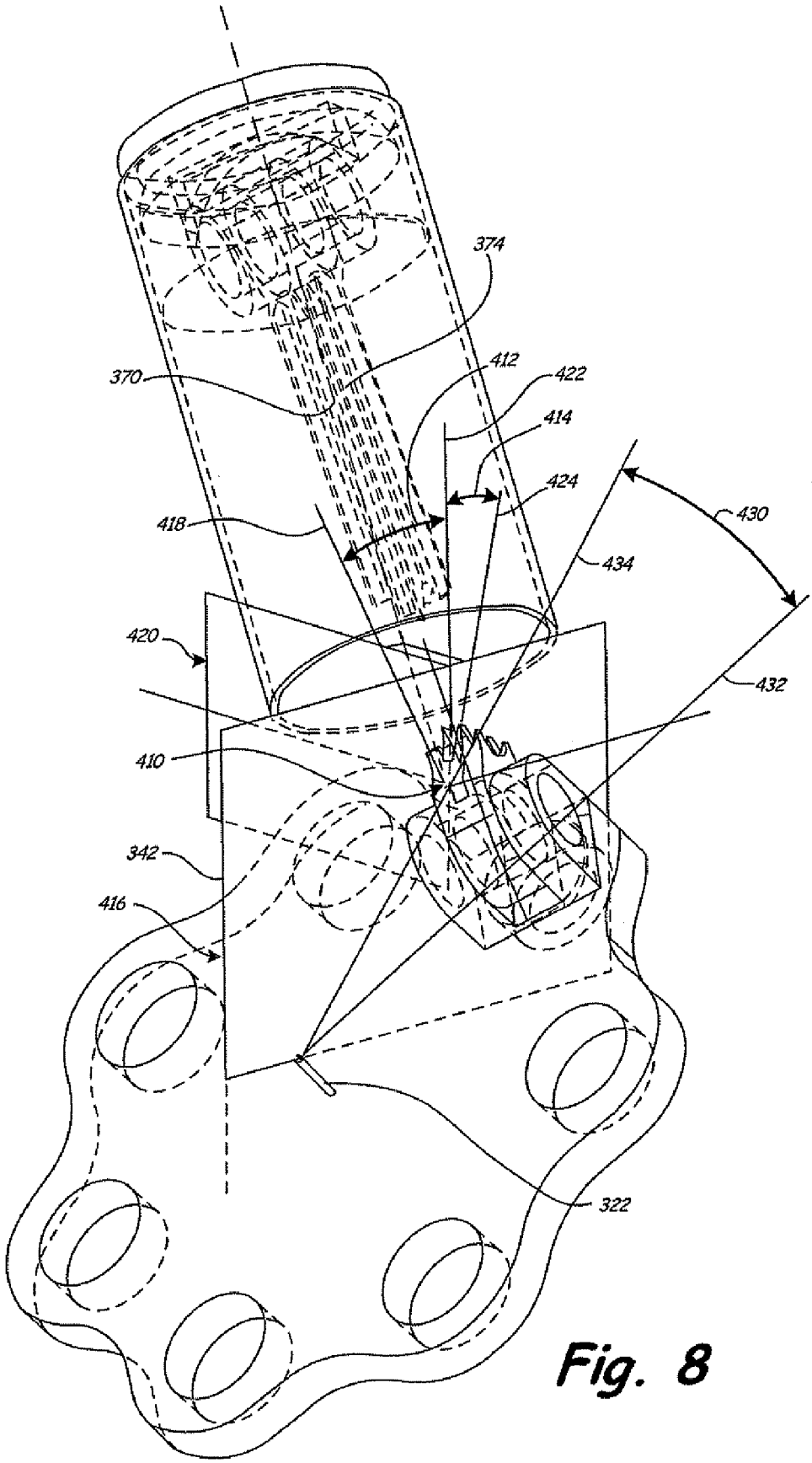
FIG. 8 is a schematic perspective view of a piston-cylinder joined to a thrust plate.
Figure 23:
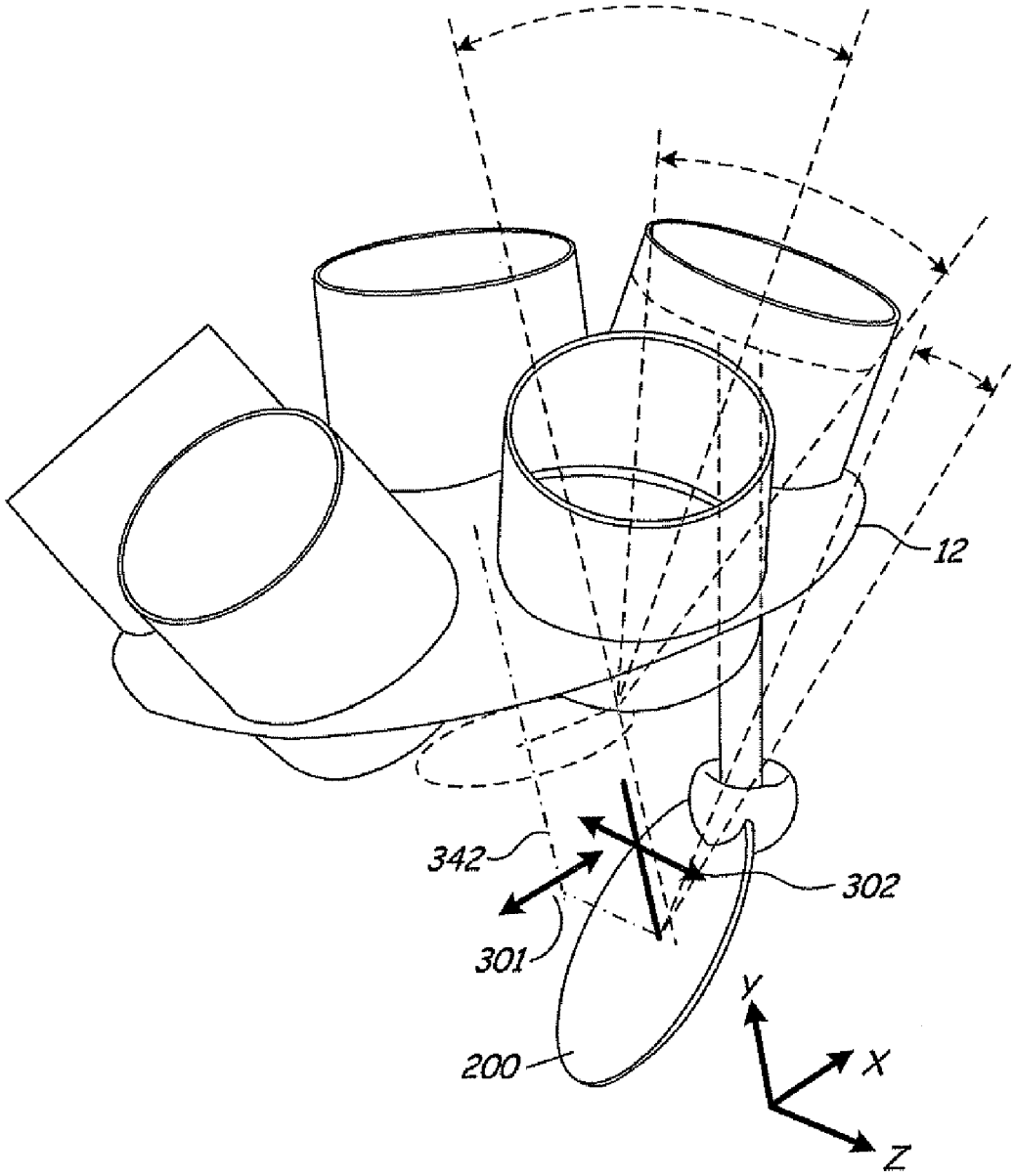
FIG. 23 is a schematic perspective view of various offsets between the thrust plate and the cylinder bank axes.
Figure 24:
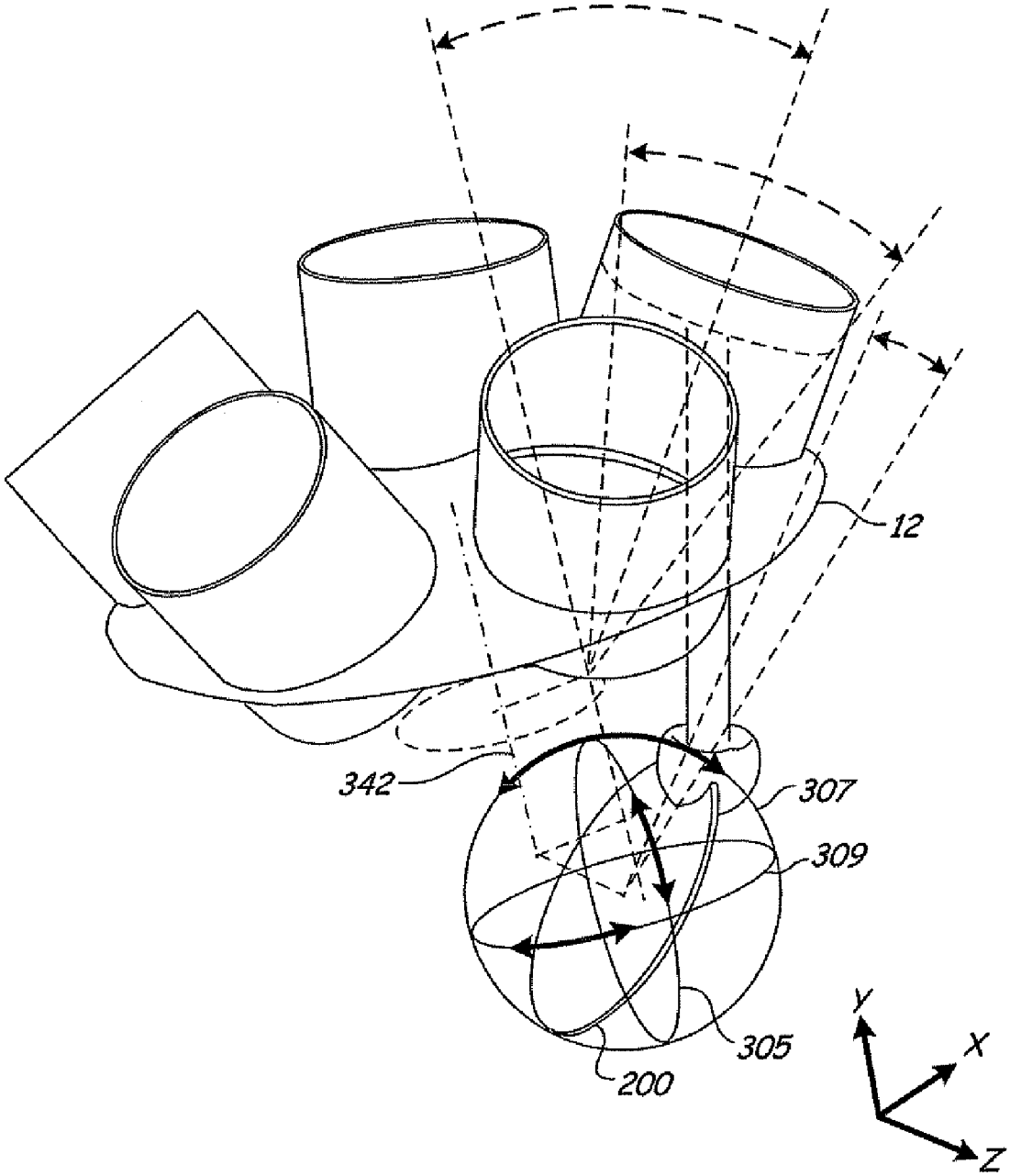
FIG. 24 is a schematic perspective view of various tilts of the thrust plate.
Figure 25:
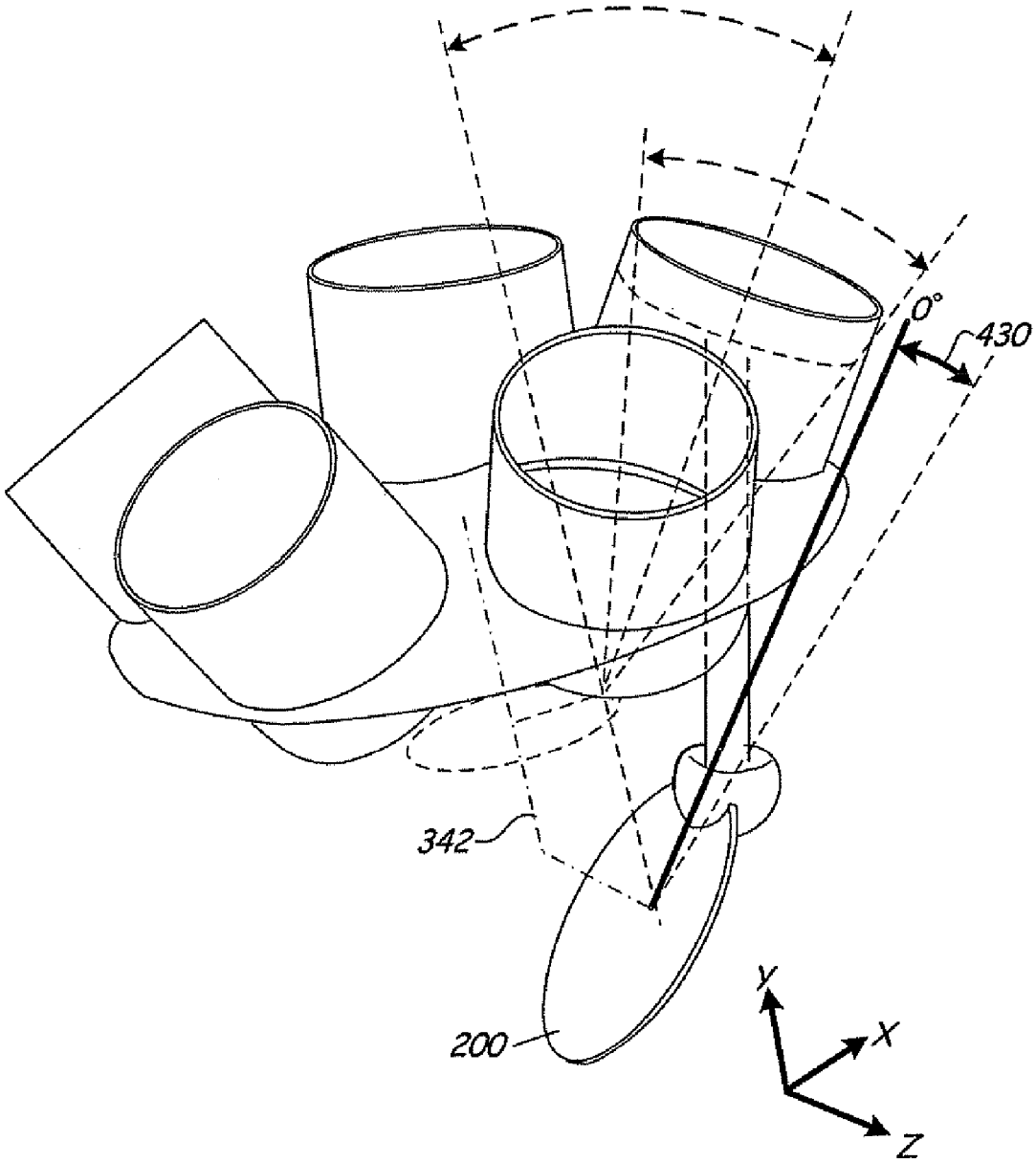
FIG. 25 is a schematic perspective view of rotation of the thrust plate about its rotational axis.

Referring to FIGS. 22-25, it has been determined that there are many factors which can improve the thermodynamic and mechanical efficiency of the above described embodiment. These factors include but are not limited to (1) the diameter of the piston, (2) the number of cylinders, (3) the length of the stroke from TDC to BDC, (4) the radius of the cylinder bank, (5) the radius of the thrust plate, (6) the displacements or offsets 301, 302 of the thrust plate axis from the central longitudinal axis (FIG. 23) in the directions along axes X and Z, (7) the angle of the thrust plate 200 with respect to the cylinder bank 12 (FIG. 24) and with respect to about the X, Y and Z axes, (8) the tilt of the major cylinder axis 42 (and hence the cylinders 46) in both a pitch 412 and a yaw 414 (FIGS. 8 and 22) (two degrees of rotational freedom relative to the central longitudinal axis 42), and (9) the advancement or retardation (i.e. angular rotational offset 430) of the bottom ends of the connecting rods by rotating the thrust plate 200 about the thrust axis 322 in the thrust plane (FIGS. 8 and 25).

From a thermodynamic perspective useful work per cycle (W) is defined as follows:

$$W=\oint pdV$$

where p is the instantaneous pressure in the combustion chamber and dV is the change in volume of the combustion chamber. Thus, it is desirable to for the piston to dwell (remain stationary or substantially stationary with respect to the cylinder wall) at the top of the cylinder while substantially all of the fuel burns to increase the pressure of the gases and then for the piston to move downward in the cylinder as quickly as possible to increase the dV. Thus, it is desirable to have a constant volume burn wherein 10% to 90% of the fuel is burned while the piston remains at the top of the cylinder and while the volume of the combustion chamber remains constant or substantially constant. Sophisticated thermodynamic modeling is necessary in order to calculate the pressures within the cylinder. However, it is estimated that a constant or substantially constant volume burn is accomplished when the piston dwells at the top of the cylinder for a crank angle interval of between 20-30 degrees. Thus, the above-mentioned 9 factors may be used to manipulate the piston position to create the desired dwell and increased pressure and then to move the piston away as quickly as possible to increase the dV of the combustion chamber. Because the pressures and temperatures resulting from a constant or substantially constant volume burn are so much higher than in a traditional reciprocating internal combustion engine, and because the burn rate is so much faster than a traditional internal combustion engine, it will be possible to run the air-fuel mixture much leaner than in a traditional internal combustion engine. Running lean extends the burn rate and effectively limits how lean an engine may run. Running lean on demand will therefore provide greater efficiency gains at the sacrifice of power density. Running lean may also alleviate any detonation problems resulting from the extremely high temperatures and pressures. Of course, it will also be possible to alleviate detonation issues by adjusting the piston motion to better control the temperature and pressure within the cylinders.

Figure 7:
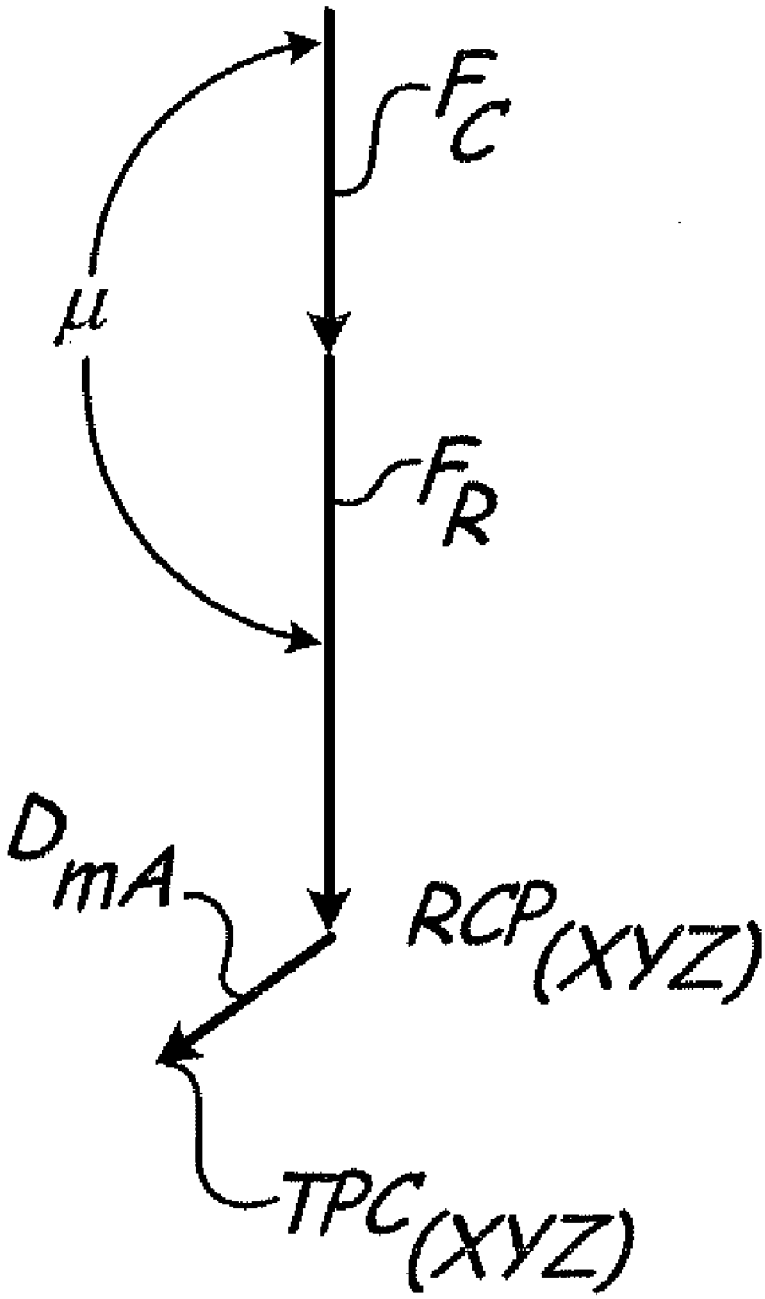
FIG. 7 is a vector diagram.

Referring to the free body diagram in FIG. 7, a detailed vector analysis may be employed to analyze the affect of these factors on the piston's position and the effective torque arm $\vec{M}_T$, as the engine rotates over 360° in order to maximize the thermodynamic and mechanical advantage of the configuration. An effective torque arm, $\vec{M}_T$, is calculated because the engine produces a torque arm along three axes, some positive and some negative, which must be resolved together. The higher the cumulative magnitude of the effective torque arm or moment, $\vec{M}_T$, the higher the overall advantage of the configuration. It should be noted that the work (W) done at the piston from a thermodynamic perspective and from using the pdV equation is the same as the moment calculated at the output shaft using the following vector analysis. To obtain the moment about the thrust plate (i.e. the effective torque arm) the following equation is used:

$$\vec{M}_T=\vec{D}_{MA}\cdot\vec{F}_R$$

Where, $\vec{M}_T$=total moment about the torque plate $\vec{D}_{MA}$=distance vector from the torque plate axis to the center of the outer end of the connecting rod $\vec{F}_R$=force vector applied to the torque plate by the connecting rod To obtain the distance vector, $D_{MA}$, we calculate the distance in each of the x, y, and z directions between the center of the thrust plate and the point at which the rod axis intersects the thrust plate. For terminology purposes, $RCP_{(x,y,z)}$=rod connection point, where the connecting rod axis intersects the torque plate $TPC_{(x,y,z)}$=torque plate center Written plainly, $$\vec{D}_{MA}=\langle RCP_x-TPC_x,\ RCP_y-TPC_y,\ RCP_z-TPC_z\rangle$$

To obtain $F_R$ we must identify the force in the cylinder $F_C$ that is applied to the piston. Since both ends of the connecting rod are free to rotate, the connecting rod can only apply a force along the axis of its length. Because the connecting rod is at an angle, μ, to the piston's direction of travel, we divide $F_C$ by the cosine of μ to obtain $F_R$. Or $$\vec{F}_R=\frac{\vec{F}_C}{\mathrm{COS}(\mu)}$$

To obtain μ we must define a vector that describes the direction of $F_R$, but not the magnitude (since this is still unknown). The vector describing the length of the connecting rod, $L_R$, does just this. $L_R$ is defined as $$\vec{L}_R=\langle RCP_x-PP_x,\ RCP_y-PP_y,\ RCP_z-PP_z\rangle$$

Where, $PP_{(x,y,z)}$=piston position (intersecting point of cylinder axis and connecting rod axis)

To obtain the angle between the two vectors $L_R$ and $F_C$, divide the dot product of $L_R$ and $F_C$ by the multiplicative product of their two respective magnitudes as given in the equation below.

$$\mu=\frac{\vec{L}_R\cdot\vec{F}_C}{\left|\vec{L}_R\right|\cdot\left|\vec{F}_C\right|}$$

We can now obtain the moment $M_T$ with our original equation; however this moment may not be in the same direction as the axis of rotation of our drive shaft. The moment about the drive shaft axis is called $M_S$. This moment has a unit vector in its direction $m_s$ that is defined as, $$\vec{m}_S=\frac{\vec{M}_S}{\left|\vec{M}_S\right|}$$

We can also define this unit vector based on the known geometry of the engine (i.e. the orientation of the drive shaftwith respect to the axis of the system). Therefore we can identify the angle, λ, between $M_T$ and $m_s$ as $$\lambda=\frac{\vec{M}_T\cdot\vec{m}_S}{\left|\vec{M}_T\right|}$$

We will multiply $M_T$ by the cosine of λ to obtain $M_S$.

$$\vec{M}_S=\mathrm{COS}(\lambda)\cdot\vec{M}_T$$

By analyzing the piston position and the effective torque arm $\vec{M}_T$ or $\vec{M}_S$ such as in a Microsoft Excel™ Spreadsheet it has been discovered that the most important factors for creating a dwell sufficient for a constant or substantially constant volume burn and then for increasing the mechanical advantage by having a fast moving piston are the cylinder tilts, the angle of the thrust plate with respect to the cylinder bank in three rotational degrees of freedom which includes its tilt with respect to two axes which are perpendicular to the central longitudinal axis and its rotational angular offset about an axis parallel to the central longitudinal axis and intersecting the thrust axis, the displacement or offset of the thrust plate axis from the central longitudinal axis (in one embodiment, such that they do not intersect), and the advancement/retardation (i.e angular rotational offset) of the thrust plate about the thrust axis. It must be understood that all of the factors are configured into the fabrication orientation of the cylinders, cylinder bank and thrust plate with respect to each other and they are not meant to be adjusted in any way whatsoever once they are designed into the engine. FIGS. 8 and 22-25 show these variables which are used to custom contour the piston motion to create a dwell for combustion and then to quickly move the piston down within the cylinder.

Figure 22:
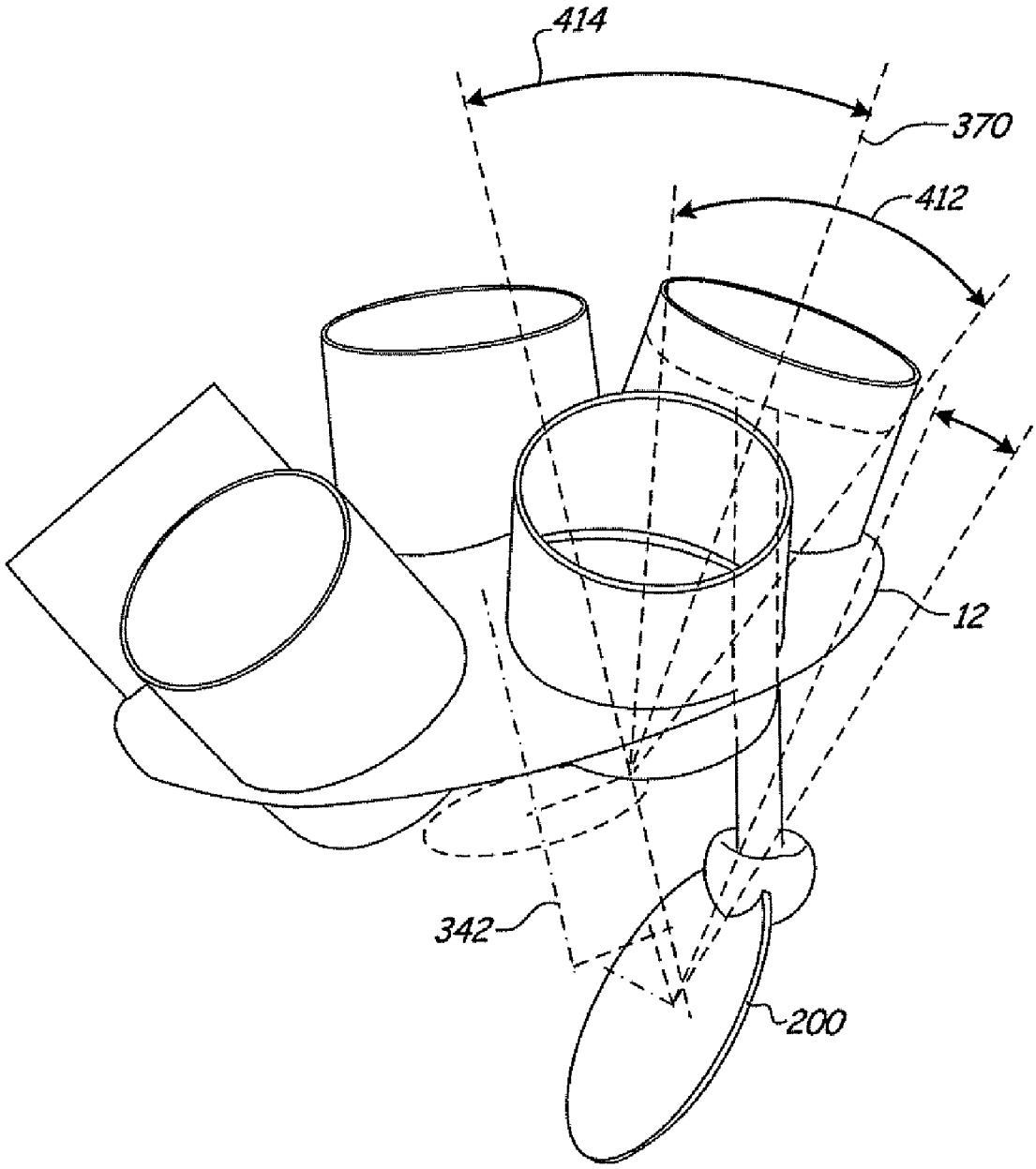
FIG. 22 is a schematic perspective view of various tilts for the plurality of cylinders.

Referring to FIGS. 8 and 22, tilting the major cylinder axis 370 so that it is not parallel to the central longitudinal axis 342, provides significant piston dwell and better aligns the connecting rod axis 374 with the thrust plate when maximum torque is delivered. The top end of each cylinder is tilted about a tilt point 410 on the major cylinder axis 370 nearest the bottom end of the cylinder in a direction away from the central longitudinal axis 342, so that the major cylinder axis 370 has both a pitch angle 412 and a yaw angle 414. The pitch angle 412 is the tilt of the top ends of the cylinders into or away from the direction of rotation of the cylinder bank and is measured as the angle between a first plane 416 which includes the central longitudinal axis 342 and the tilt point 410, and a projection 418 of the major cylinder axis 370 onto a second plane 420 which is perpendicular to the first plane 416 and parallel to the center longitudinal axis 342 and which includes the tilt point 410. The yaw angle 414 is the tilt of the top ends of the cylinders into or away from the central longitudinal axis and is measured as the angle between a line 422 formed by the intersection of the first plane 416 and the second plane 420, and a projection 424 of the major cylinder axis 370 onto the first plane 416. Generally, the yaw angle 414 brings the lower ends of the cylinders together, while causing the upper ends to spread apart from each other. The probabilistic ranges for both the pitch angle 412 and the yaw angle 414 are between 0° and 70° depending on the configuration and the other factors.

The thrust plate angle was discussed above with regard to increasing the displacement of the engine. Referring to FIG. 24, it should be noted that the thrust plate angle includes an X tilt angle 305 which is an angle measured in a plane perpendicular to the central longitudinal axis 342 and including the X and Z axes, a Z tilt angle 307 which is an angle measured in a plane perpendicular to the central longitudinal axis 342 and including the X and Z axes, and a Y rotation angle 309 which is an angle measured by rotating the thrust plate 200 about the Y axis which is parallel to the central longitudinal axis 342. All three tilts (i.e. three rotational degrees of freedom) of the thrust plate can be used to affect the motion of the piston to create the dwell and to quickly move the piston after the dwell.

Referring to FIGS. 8 and 23, the displacements or offsets 301 and 302 of the thrust plate axis from the central longitudinal axis 342 results from moving the cylinder bank 12 and/or thrust plate 200 laterally with respect to each other (see FIGS. 12 and 16) so that the thrust plate axis and central longitudinal axis do not intersect. In order to synchronize rotation speed of the cylinder carriage 12 with the thrust plate 200 when these two axes are offset, it becomes necessary to use a cardan-type gear set in the power take off assembly as described below with respect to FIG. 12. In combination with the tilting of the major cylinder axis, one or both of the offsets of the thrust plate axis from the central longitudinal axis has a dramatic effect on the piston motion to create the dwell and to quickly move the piston after the dwell.

Referring to FIGS. 8 and 25, the angle 430 of advancement/retardation of the thrust plate 200 is defined as the angular rotationally offset of the thrust plate 200 about the thrust axis and with respect to a reference point in the thrust plane (represented by the thrust plate 200). The angle of advancement/retardation 430 is the angular differential between two lines in the thrust plane, wherein the first line 432 is between the thrust axis 322 and a reference point at the outer end of the connecting rod when the piston is in the up most position, and wherein the second line 434 is between the thrust axis 322 and the outer end of the connecting rod after the thrust plate 200 has been advanced or retarded about the thrust axis while the cylinder bank remains fixed. In the traditional sense, when the piston is at TDC, the major cylinder axis 370 is substantially aligned with the rod axis 374. The idea behind the advancement/retardation angle is that the thrust plate is advanced in the direction of rotation or retarded in the opposite direction of rotation so that the rod axis 374 is advanced or retarded, respectively, from the major cylinder axis 372 by an angle, $\alpha$. This is equivalent to advancing or retarding the cylinder bank so that the rod axis 374 is advanced or retarded from the cylinder axis 370 by the angle, $\alpha$. The probabilistic range for the advancement/retardation angle $\alpha$ measured on the thrust plate is between 0° and 35° in either direction about the up most piston position. The surprising and unexpected effect of advancing/retarding the thrust plate with respect to the cylinder bank is that it increases the duration of the power stroke to be greater or less than 180° and changes the motion of the piston within the cylinder from TDC to BDC to enhance the dwell and quickly move the piston after the dwell. The duration of the power stoke is measured in degrees of rotation of the thrust plate in the thrust plane using the outer end of the connecting rod as the reference point as the piston moves from TDC where it is in the up most position within the cylinder to BDC where it is in the down most position within the cylinder. Depending on engine parameters and application it may be desirable to vary the duration of the intake and power strokes compared to the compression and exhaust strokes. More particularly, it may be more desirable to shorten the duration of the power stroke so that the piston moves faster after the substantially constant volume combustion which takes place during the dwell.

With regard to the other factors it is desirable to increase the diameter of the pistons as large as possible to provide optimal rod clearance as the system rotates and also to increases the cubic displacement of the engine and power density. Reducing the number of cylinders improves rod clearance issues and permits a shorter stroke engine, but this has to be balanced with having a smooth running engine. The stroke of the engine depends on its application and engine speed-in higher speed engines it is desirable to a have the stroke equal to the diameter of the piston (i.e. bore size) to reduce mean piston speed and associated ring losses. The diameter of the cylinder bank and thrust plate must be balanced with the other engine parameters to achieve the desired stroke.

It must be understood that while the mathematical analysis may yield an optimal configuration for the piston position, there are practical limitations in constructing the parts so that the rods neither clash with their own cylinder walls nor the adjacent rods or cylinders walls as the cylinder bank rotates over a full 360°. Thus, while the mathematical analysis provides guidance in determining which factors are most important for maximizing mechanical advantage, all of the factors must be adjusted to properly configure the cylinder bank with respect to the thrust plate for rod clearance. As a practical matter, rod clearances may be most easily determined using three-dimensional computer modeling software like SolidWorks™ by SolidWorks Corporation of Concord, Mass. Rod clearance issues can dramatically limit the ability to configure an engine. One counterintuitive method for achieving rod clearance is to increase piston diameter and cylinder diameter and to nest the lower ends of the cylinders as close as possible to each other. This has the desirable effect of increasing the displacement of the pistons while shortening the stroke, thereby improving the power density of the engine and reducing piston speed.

Figure 9:
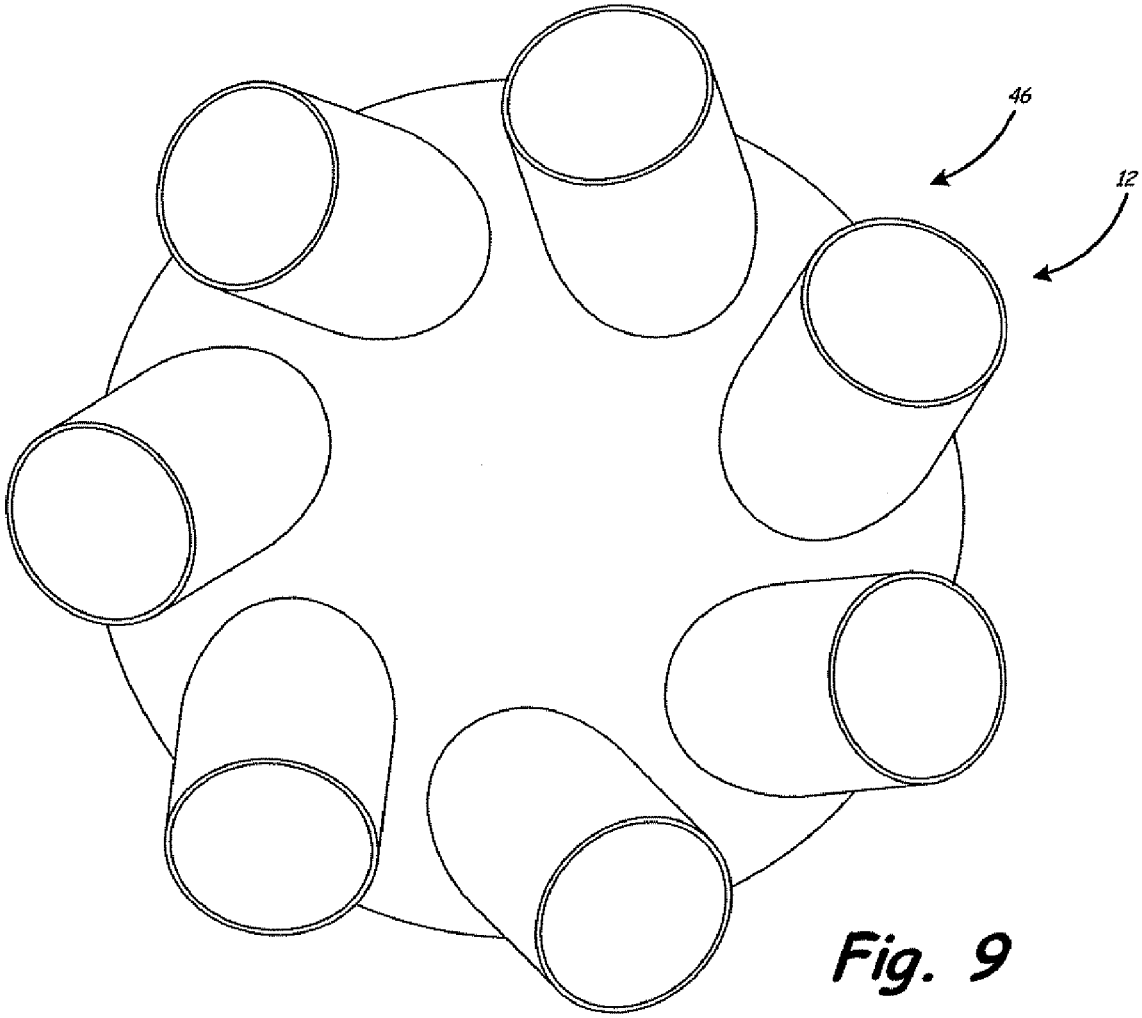
FIG. 9 is a top plan view of a plurality of tilted cylinders.
Figure 10:
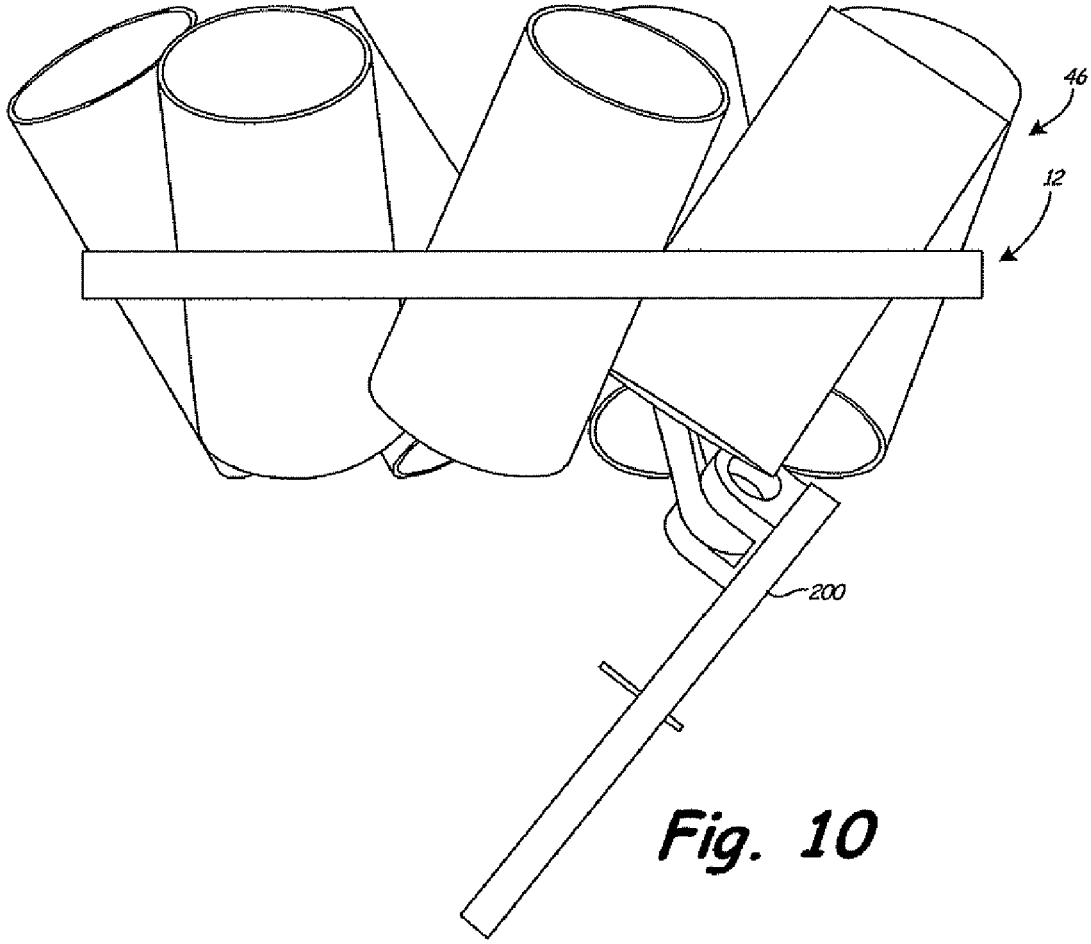
FIG. 10 is a side elevational view of the plurality of tilted cylinders.
Figure 11:
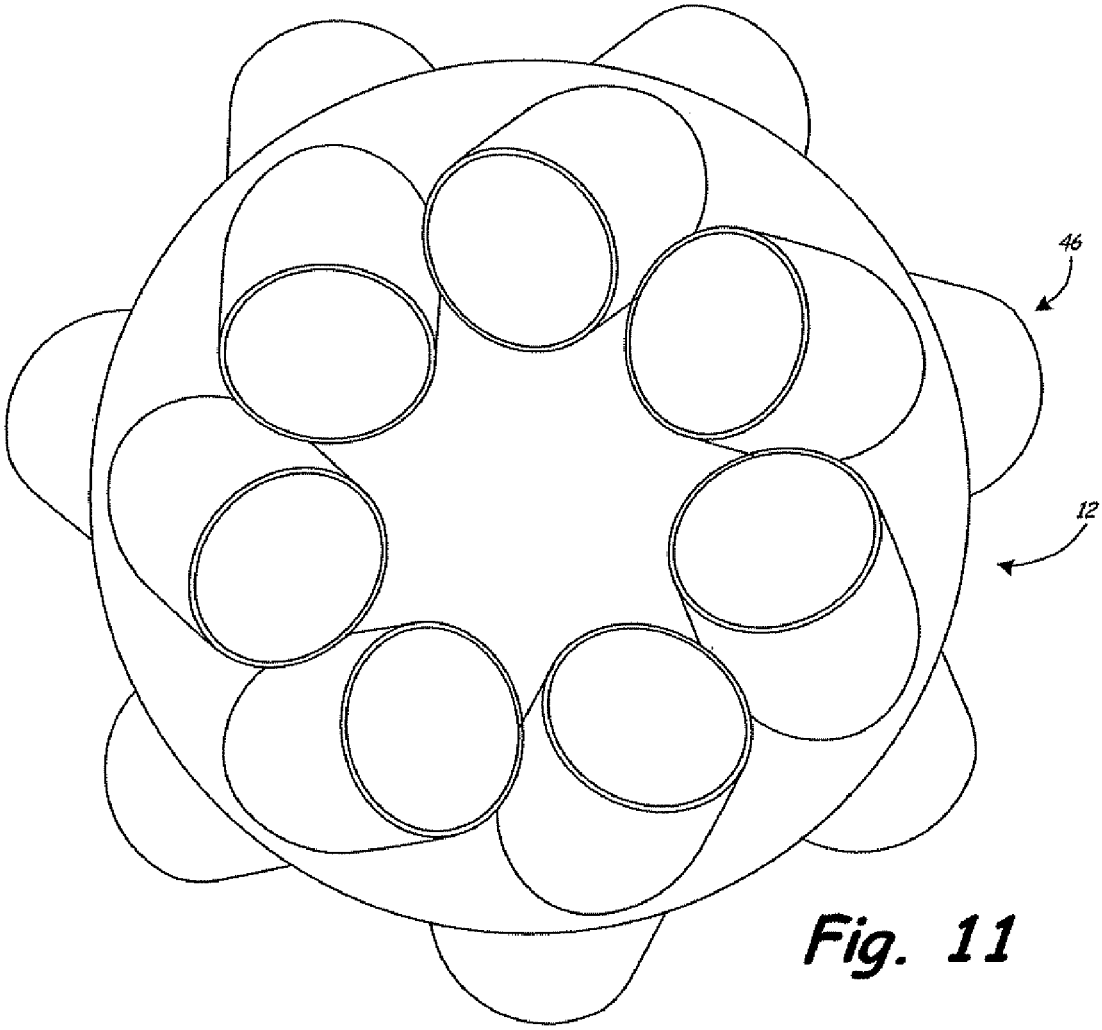
FIG. 11 is a bottom plan view of the plurality of tilted cylinders.

FIG. 9, is a top plan schematic of the cylinder bank 12 showing the cylinders 46 tilted with both a pitch angle and a yaw angle wherein the top ends of the cylinders 46 are spaced apart from each other. FIG. 10 is a side view schematic of the cylinder bank 12 and thrust plate 200 showing the cylinder tilt and the nesting of the lower ends of the cylinders 46. FIG. 11, is a bottom plan schematic of the cylinder bank 12 showing the tightest nesting position wherein a leading edge of the lower ends of each cylinder is touching the adjacent cylinders. Nesting the lower ends of the cylinders 46 in this manner allows the radius of the cylinder bank 12 to be at a minimum, thereby minimizing centripetal forces.

Referring to FIGS. 22-25, one embodiment of a five cylinder engine without the torque plate axis being offset from the central longitudinal axis (i.e. without the cardan-type joint) is described by the following specifications:

| | |
|---|---|
| 7.65 inches | Effective rod length which is the length of the rod from the center of the outer end joint to the intersection of the rod's axis and the cylinder's axis |
| 2.04 inches | Radius of the cylinder carriage circle from the center of rotation to the center of the cylinder |
| 3.06 inches | Radius of the thrust plate from its center to the center of the outer end of the connecting rod |
| 4.675 inches | Diameter of the piston |
| 0 degrees | Angle of the thrust plate with respect to the Z axis in a plane perpendicular to the central longitudinal axis |
| 50 | Angle of the thrust plate with respect to the X axis in a plane perpendicular to the central longitudinal axis |
| 30 | Angle of the thrust plate with respect to the Y axis in a plane perpendicular to the central longitudinal axis |
| 40 degrees | Yaw angle |
| 5 degrees | Pitch angle |
| 10 degrees | Advancement angle of thrust plate with respect o cylinder bank |
| 0 inches | Offset of the x coordinate of the center of the top surface of the thrust plate |
| 0 inches | Offset of z coordinate of the center of the top surface of the thrust plate |

Figure 26:
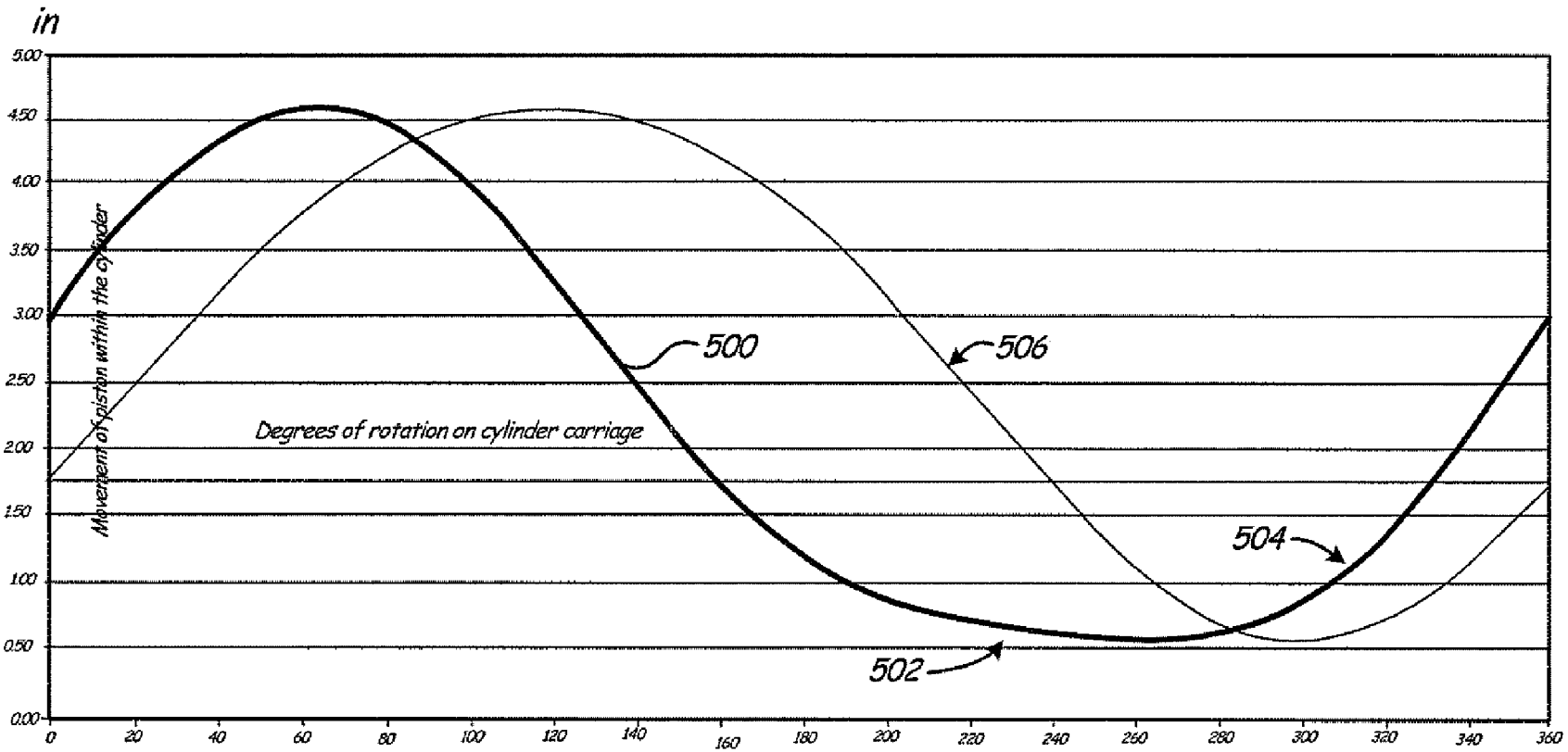
FIG. 26 is a plot showing piston position within a cylinder versus degree of rotation of the cylinder for an embodiment of a rotating barrel engine and a conventional internal combustion engine.

Referring to FIG. 26, piston motion for this embodiment is illustrated at 500, which shows a substantial dwell 502 and then a fast moving piston region 504. In contrast, piston movement for a conventional crankshaft internal combustion engine is illustrated at 506, which has substantially no dwell.

Another embodiment of a five cylinder engine with the torque plate axis being offset from the central longitudinal axis (i.e. with the cardan-type joint) is described by the following specifications:

| | |
|---|---|
| 7.65 inches | Effective rod length which is the length of the rod from the center of the outer end joint to the intersection of the rod's axis and the cylinder's axis |
| 2.04 inches | Radius of the cylinder carriage circle from the center of rotation to the center of the cylinder |
| 3.06 inches | Radius of the thrust plate from its center to the center of the outer end of the connecting rod |
| 4.675 inches | Diameter of the piston |
| 0 degrees | Angle of the thrust plate with respect to the Z axis in a plane perpendicular to the central longitudinal axis |
| 50 | Angle of the thrust plate with respect to the X axis in a plane perpendicular to the central longitudinal axis |
| −15 | Angle of the thrust plate with respect to the Y axis in a plane perpendicular to the central longitudinal axis |
| 40 degrees | Yaw angle |
| 5 degrees | Pitch angle |
| 10 degrees | Advancement angle of thrust plate with respect o cylinder bank |
| 1 inches | Offset of the x coordinate of the center of the top surface of the thrust plate |
| 0 inches | Offset of z coordinate of the center of the top surface of the thrust plate |

Figure 27:
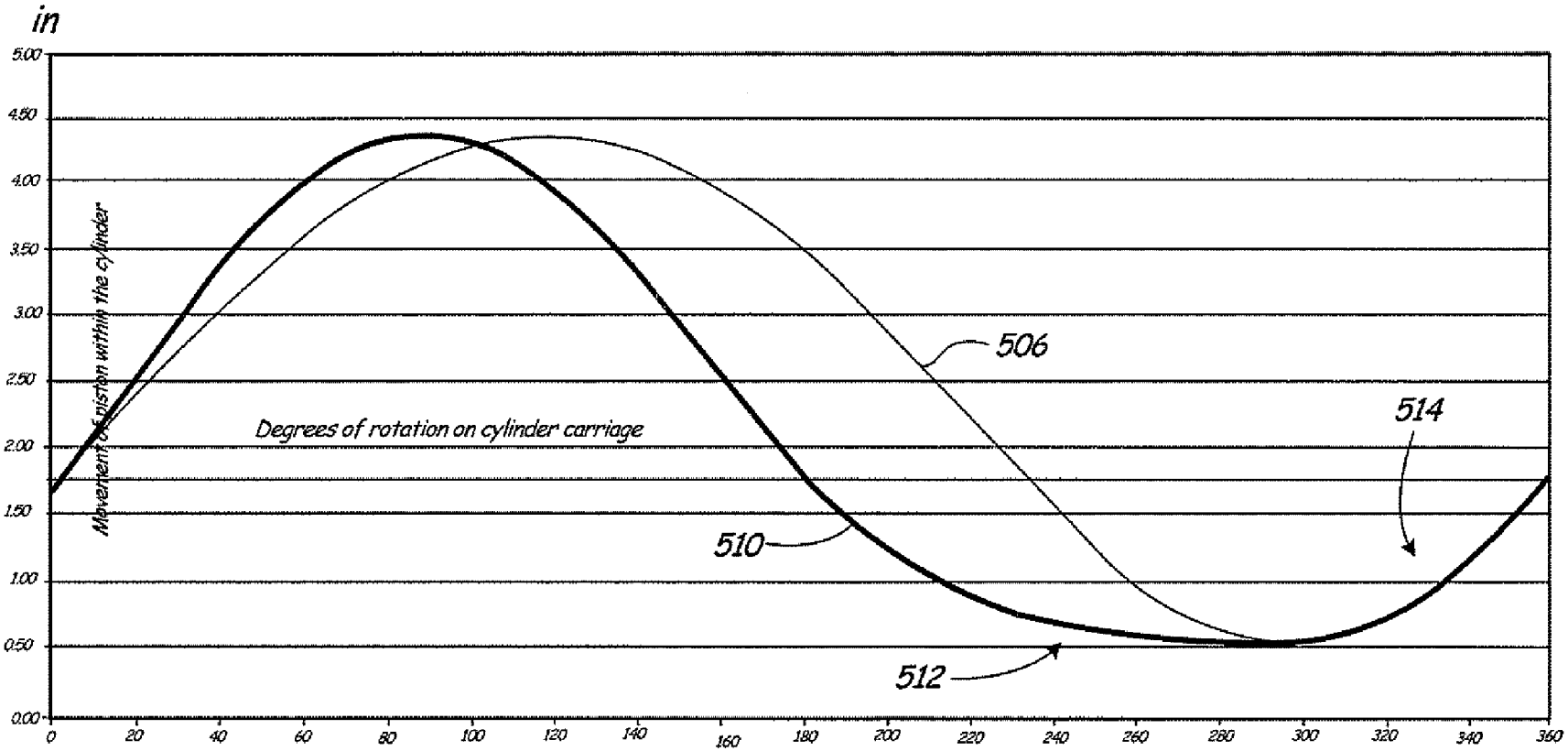
FIG. 27 is a plot showing piston position within a cylinder versus degree of rotation of the cylinder for a second embodiment of a rotating barrel engine and a conventional internal combustion engine.

Referring to FIG. 27, piston motion for this embodiment is illustrated at 510, which shows a substantial dwell 512 and then a fast moving piston region 514. In contrast, piston movement for a conventional crankshaft internal combustion engine is illustrated at 506, which has substantially no dwell.

It must be understood that there are countless possible combinations of the design factors which can create any desired piston motion and detailed thermodynamic study is required to determine the most optimal configuration, with strong consideration given reducing the complexity of the engine while maintaining the desired piston motion and fast moving piston after the dwell.

Figure 12:
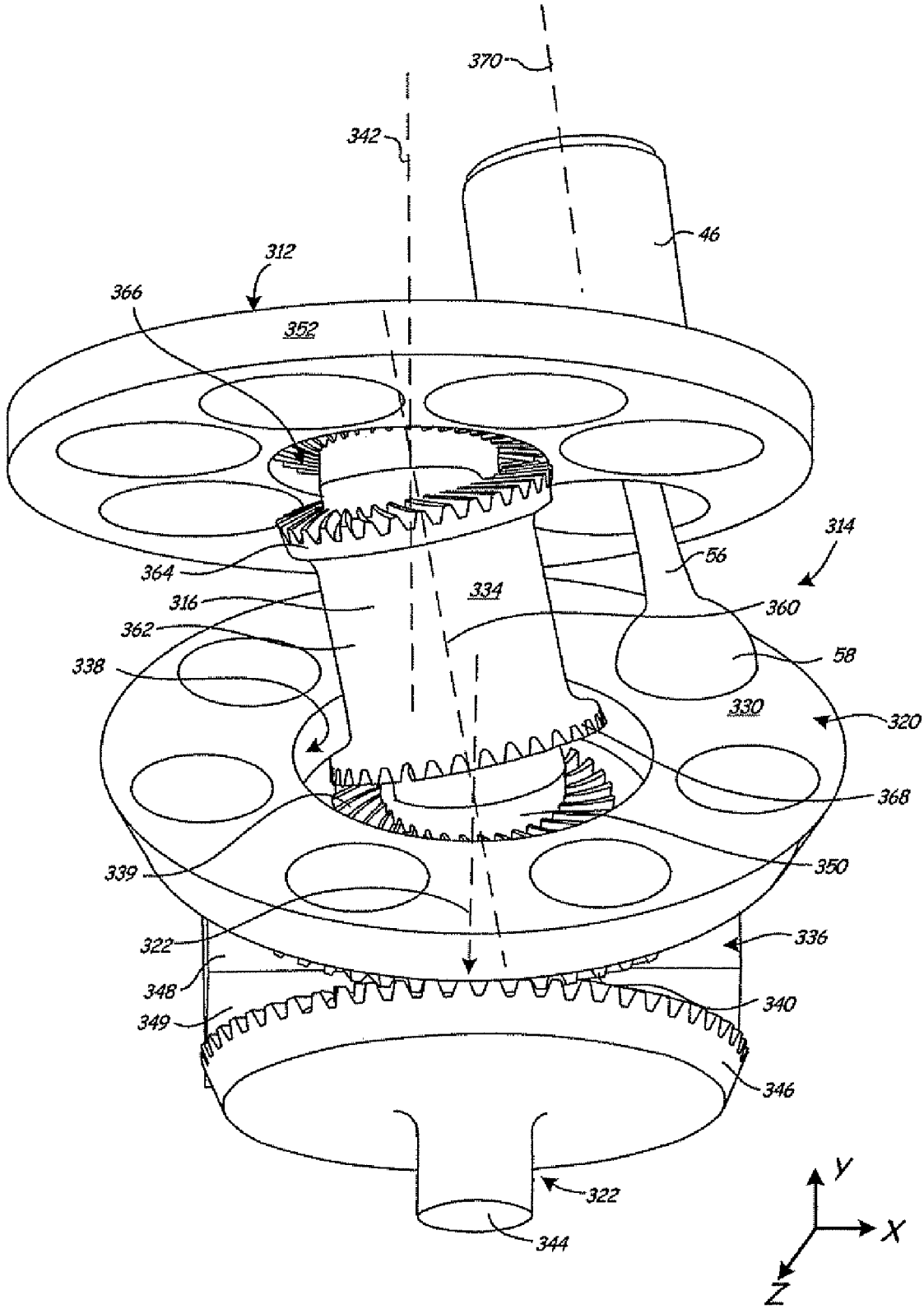
FIG. 12 is a schematic/perspective view of a cardan joint.

Referring to FIG. 12, another embodiment of the power take off assembly 314 is illustrated in partial schematic form. In this embodiment the power take off assembly 314 includes a synchronizing member 316 operatively connected to the cylinder bank assembly 312 and the thrust plate 320 so that the cylinder bank assembly 312 and thrust plate 320 rotate at the same speed, and so that a center axis 322 of the thrust plate 320 is offset with respect to the central longitudinal axis 342 in a direction along both the x and y axes, which provides greater mechanical advantage and/or improved rod clearance. More specifically, the power take off assembly 314 includes a donut-shaped thrust plate 330 which revolves about the center axis 322 which is offset from and does not intersect the center longitudinal axis 342, a power take off 332, a cardan-type gear set 334 for synchronizing the thrust plate 330 to the cylinder bank assembly 312, and a stationary thrust housing 336 for supporting the thrust plate 330, the power take off 332, and the cardan-type gear set 334. The donut-shaped thrust plate 330 includes a central opening 338, a synchronizing gear 339 set into an inner surface thereof, and an output gear 340 set into a peripheral surface thereof. The power take off 332 includes an output shaft 344 and a power transfer gear 346 synchronized to the output gear 340 of the thrust plate 330 for transferring power therefrom in a one to one ratio. It should be noted that the power transfer ratio can be adjusted to meet any particular application. The stationary thrust housing 336 includes a first bearing surface 348 for supporting the thrust plate 330, a second bearing surface 349 for supporting the power take off 332, and a stationary shaft 350 which extends up through the central opening 338 of the donut-shaped thrust plate 330 forming an offset axis 360 which intersects the center axis 322 of the thrust plate 330 and the central longitudinal axis 342 and which rotatably supports the cardan-type gear set 334 thereabout. The cardan-type gear set 334 includes a torque tube 362 rotatably mounted on bearings (not shown) about the stationary shaft 350 on the offset axis 360, an upper synchronizing gear 364 which meshes with a synchronizing gear 366 on the underside of the cylinder carriage 352, and a lower synchronizing gear 368 which meshes with the synchronizing thrust plate gear 339. The center axis 322 of the thrust plate 330 is offset from the central longitudinal axis 342 to optimize the piston motion to create the dwell and to quickly move the piston after the dwell.

Figure 13:
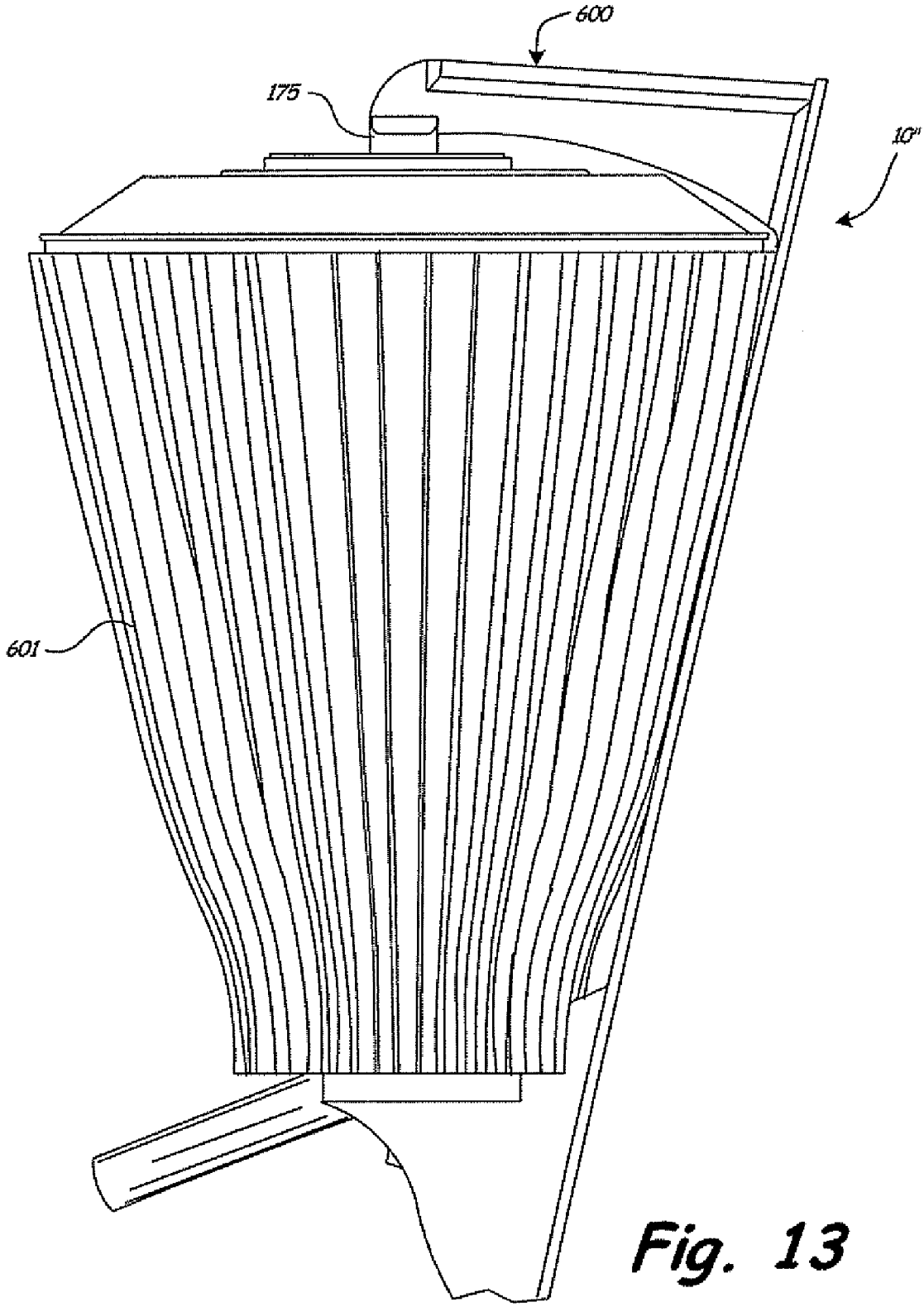
FIG. 13 is a perspective view of a second embodiment of a rotating barrel engine.
Figure 14:
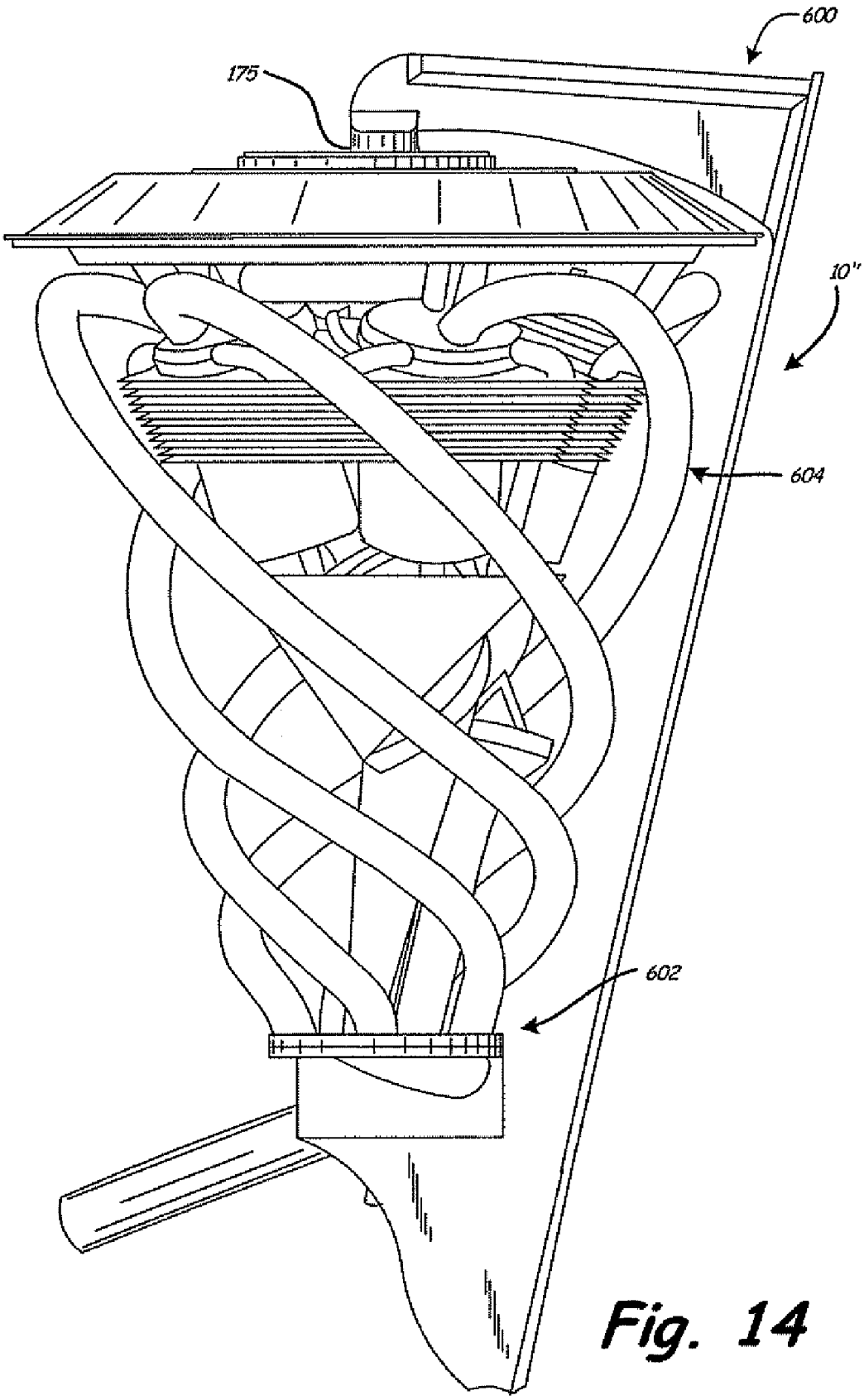
FIG. 14 is a perspective view of the second embodiment of the rotating barrel engine with an outer cover removed.

FIGS. 13-21 illustrates features of other embodiments of rotating barrel type internal combustion engines having further aspects of the present invention. In the embodiment of FIGS. 13-14, the engine 10" rotates about a stationary central support shaft 175, which is fixedly attached to stationary support housing 600. An outer cover is indicated at 601. Thus, in this embodiment the bearings (not shown) are generally about the support shaft 175 and not on the periphery of the cylinder bank 12 as in the earlier exemplary embodiment. The central support shaft 175 permits a common exhaust manifold 602 with a flat exhaust seal at the bottom of the engine. The length and shape of the exhaust pipes 604 from the cylinders to the common exhaust manifold 602 can be adjusted to tune the exhaust gases for desired Helmholtz effect.

Figure 15:
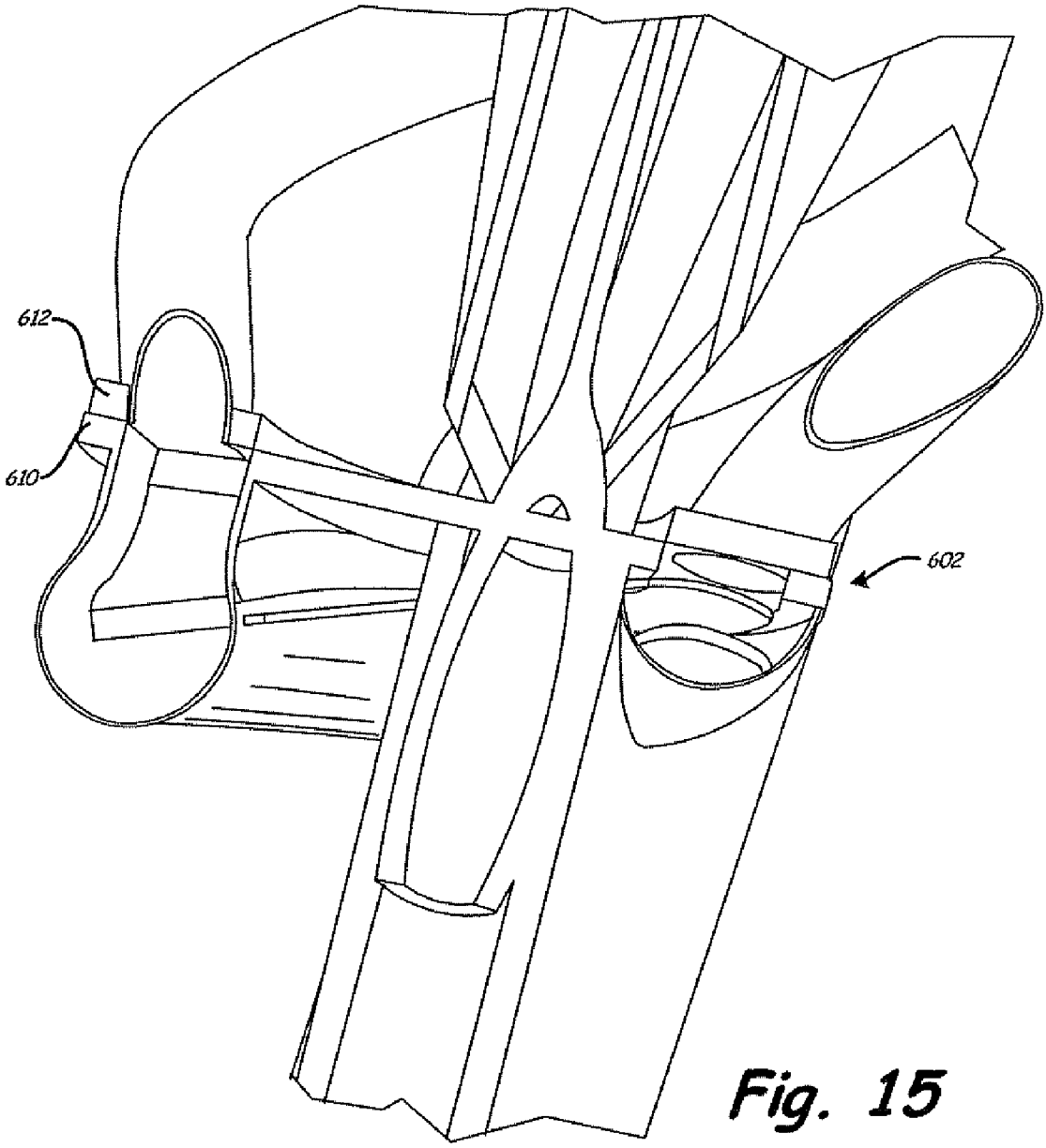
FIG. 15 is an enlarged sectional view of an exhaust manifold assembly.
Figure 16:
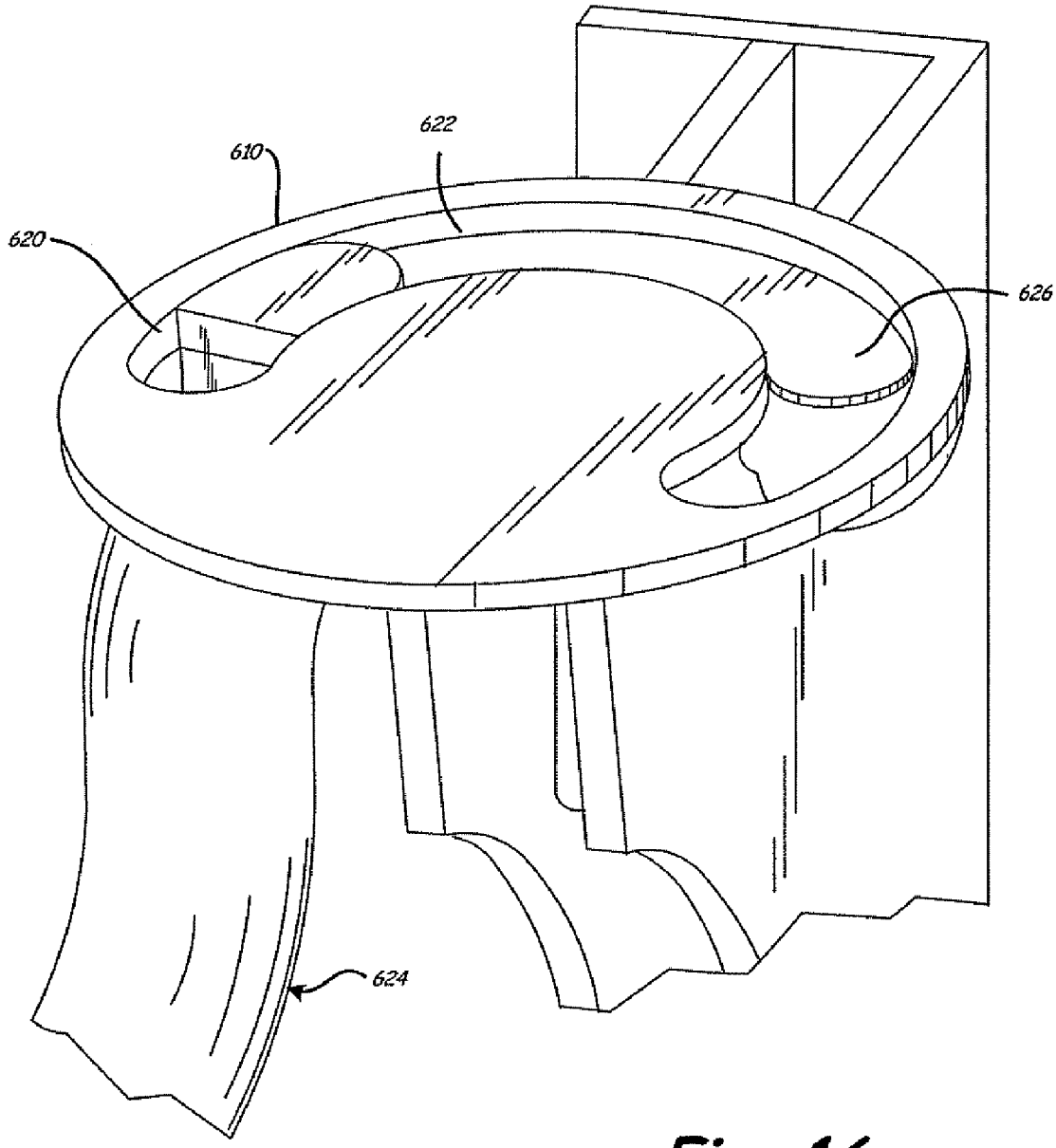
FIG. 16 is a perspective view of a portion of the exhaust manifold assembly.

As illustrated in FIGS. 15 and 16, the common exhaust manifold 602 includes a stationary exhaust gas pickup 610, a rotating plate 612 which is attached to the ends of the rotating pipes 604, and a rotating seal (not shown) between the stationary exhaust gas pickup 610 and the rotating plate 612. The exhaust gas pickup 610 includes a blowdown area 620 which receives the initial exhaust gases which are under the highest pressures, and a secondary exhaust chamber 622 which continues for the balance of the exhaust stroke. The exhaust gases from the blowdown area 620 feed directly into a common stationary tail pipe 624 through an opening while the exhaust gases from the secondary exhaust chamber 622 first move in the direction of the rotating exhaust plate 612 between a flow plate 626 and the rotating plate 612 and then loop back underneath the flow plate 626 to the blowdown area 620 where they flow into the tail pipe 624. A venturi effect is thus created in the stationary exhaust pickup 610 between the blowdown area 620 and the secondary exhaust chamber 622 wherein the higher pressure blowdown gases from one cylinder pull the remnant gases from the preceding cylinder out the tail pipe 624. The rotating seal is made from conventional material and is positioned between the rotating plate 612 and the stationary exhaust gas pickup 610 to prevent exhaust gases from leaking out and from leaking between the blowdown area 620 and the secondary exhaust pickup 622. It may be desirable to back pressure the exhaust seal to make sure there is no exhaust gas leakage.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims. In addition, workers skilled in the art will recognize that changes may be made in form and detail without departing from the spirit and scope of the inventive concepts described herein. For example, slight modifications to the structure of the present invention which has been described with respect to internal combustion engines, would permit the functioning principals of the design to be applied to two-cycle, diesel, steam and sterling cycle pumps and engines.

What is claimed is:

1. An engine block assembly comprising:

a stationary housing;

a cylinder bank rotatably mounted to the housing about a central longitudinal axis, the cylinder bank having a plurality of cylinders therein radially distanced from the central longitudinal axis, each cylinder having associated therewith a cylinder wall formed about a major cylinder axis;

a plurality of pistons wherein one piston is provided in each cylinder to form a combustion chamber therein, wherein each piston sequentially moves from a down most position within the cylinder to an up most position within the cylinder during a first portion of rotation of the cylinder bank, wherein each piston sequentially dwells about the up most position for substantially all of an air-fuel mixture to be combusted within the combustion chamber, and wherein each piston then sequentially moves from about the up most position to the down most position during a second portion of rotation of the cylinder;

a plurality of connecting rods each having a proximal end attached to a respective piston, and a remote end distant from the respective piston;

a thrust plate operatively connected to the remote ends of the connecting rods, the thrust plate being rotatably mounted to the stationary housing about a thrust plate axis and in a thrust plane defined by the remote ends of the connecting rods;

a synchronizing member operatively connecting to the cylinder bank and the thrust plate so that the cylinder bank and thrust plate rotate at the same speed; and wherein the piston dwell motion is created by adjusting one or more of the following design parameters: (1) the angle of the thrust plane with respect to a plane that is perpendicular to the central longitudinal axis, (2) the angular rotational offset of the thrust plate about an axis which is parallel to the central longitudinal axis and which intersects the thrust plate axis, (3) the angular rotational offset of the thrust plate about the thrust plate axis with respect to a reference point in the thrust plane, (4) the lateral offset of the thrust plate axis from the central longitudinal axis, and (5) the tilt of the major cylinder axes with respect to the central longitudinal axis.

2. The engine block assembly of claim 1, wherein each piston moves substantially faster during the second portion of rotation than during the first portion of rotation.

3. The engine block assembly of claim 2; and wherein the first portion of rotation of the cylinder bank is substantially greater than 180.

4. The engine block assembly of claim 3, wherein the first portion of rotation of the cylinder bank is less than 170.degree.

5. The engine block assembly of claim 1, wherein the angle of the thrust plane (1) is measured in two rotational degrees of freedom.

6. The engine block assembly of claim 1, wherein tilt of the major cylinder axes (5) is in two rotational degrees of freedom with respect to the central longitudinal axis, so that the major cylinder axes are not parallel to the central longitudinal axis.

7. The engine block assembly of claim 6, wherein the tilt of the major cylinder axes is such that the tops of the cylinders tilt away from the central longitudinal axis and into the direction of rotation of the cylinder bank.

8. The engine block assembly of claim 6, wherein the top end of each cylinder is tilted about a tilt point so that the major cylinder axis has a yaw angle, wherein the yaw angle is the angle between two lines, a first line formed by the intersection of a first plane which includes the central longitudinal axis and the tilt point, and a second plane which is perpendicular to the first plane, parallel to the center longitudinal axis and which also includes the tilt point, and a second line which is the projection of the major cylinder axis onto the first plane.

9. The engine block assembly of claim 6, wherein a top end of each cylinder is tilted about a tilt point on the major cylinder axis adjacent a bottom end of the cylinder so that the major cylinder axis has a pitch angle, wherein the pitch angle is the angle between a first plane which includes the central longitudinal axis and the tilt point, and a line which is the projection of the major cylinder axis onto a second plane which is perpendicular to the first plane, parallel to the center longitudinal axis and includes the tilt point.

10. The engine block assembly of claim 1, wherein the angular rotational offset of the thrust plate is greater than 0.degree. and less than 35.degree. as measured about the thrust plate axis and within the thrust plane.

11. The engine block assembly of claim 1, wherein the thrust plate is toroidal in shape.

12. The engine block assembly of claim 11, wherein a portion of the stationary housing extends through the toroidal thrust plate for supporting the synchronizing member.

13. The engine block assembly of claim 12, wherein the synchronizing member includes a first set of gears for mating the cylinder bank to the synchronizing member and a second set of gears for mating the synchronizing member to the thrust plate.

14. An engine block assembly comprising:

a stationary housing;

a cylinder bank rotatably mounted to the stationary housing about a central longitudinal axis, the cylinder bank having a plurality of cylinders therein radially distanced from the central longitudinal axis, each cylinder having associated therewith a cylinder wall formed about a major cylinder axis;

a plurality of pistons wherein one piston is provided in each cylinder to form a combustion chamber therein, wherein each piston is movable along the major cylindrical axis between an up most position to a down most position within the respective cylinder as the cylinder bank rotates, each piston having a connecting rod and a connecting rod end remote from the piston; and a thrust plate operatively connected to the remote ends of the connecting rods, the thrust plate being rotatably mounted to the stationary housing about a thrust axis and in a thrust plane, wherein the angle of the thrust plane is measured using two rotational degrees of freedom with respect to the cylinder bank.

15. The engine block assembly of claim 14, wherein the major cylinder axes are tilted with respect to the central longitudinal axis, so that each piston dwells about the up most position as the cylinder bank rotates thereby permitting a substantially constant volume combustion process to take place within each combustion chamber.

16. The engine block assembly of claim 15, wherein each piston sequentially moves from the down most position within the cylinder to the up most position within the cylinder during a first portion of rotation of the cylinder bank, wherein each piston sequentially dwells about the up most position for substantially all of an air-fuel mixture to be combusted within the combustion chamber, and wherein each piston then sequentially moves from about the up most position to the down most position during a second portion of rotation of the cylinder.

17. The engine block assembly of claim 16, wherein each piston moves substantially faster during the second portion of rotation than during the first portion of rotation.

18. An engine block assembly comprising:

a stationary housing;

a cylinder bank rotatably mounted to the stationary housing about a central longitudinal axis, the cylinder bank having a plurality of cylinders therein radially distanced from the central longitudinal axis, each cylinder having associated therewith a cylinder wall formed about a major cylinder axis;

a plurality of pistons wherein one piston is provided in each cylinder to form a combustion chamber therein, wherein each piston is movable along the major cylindrical axis between an up most position to a down most position within the respective cylinder as the cylinder bank rotates, each piston having a connecting rod and a connecting rod end remote from the piston; and a thrust plate operatively connected to the remote ends of the connecting rods, the thrust plate being rotatably mounted to the stationary housing about a thrust axis and in a thrust plane, wherein the thrust plate is angularly rotationally offset about an axis which is parallel to the central longitudinal axis and which intersects the thrust plate axis.

19. The engine block assembly of claim 18, wherein the major cylinder axes are tilted with respect to the central longitudinal axis, so that each piston dwells about the up most position as the cylinder bank rotates thereby permitting a substantially constant volume combustion process to take place within each combustion chamber.

20. The engine block assembly of claim 18, wherein each piston sequentially moves from the down most position within the cylinder to the up most position within the cylinder during a first portion of rotation of the cylinder bank, wherein each piston sequentially dwells about the up most position for substantially all of an air-fuel mixture to be combusted within the combustion chamber, and wherein each piston then sequentially moves from about the up most position to the down most position during a second portion of rotation of the cylinder.

21. The engine block assembly of claim 20, wherein each piston moves substantially faster during the second portion of rotation than during the first portion of rotation.

22. An engine block assembly comprising:

a stationary housing;

a cylinder bank rotatably mounted to the stationary housing about a central longitudinal axis, the cylinder bank having a plurality of cylinders therein radially distanced from the central longitudinal axis, each cylinder having associated therewith a cylinder wall formed about a major cylinder axis;

a plurality of pistons wherein one piston is provided in each cylinder to form a combustion chamber therein, wherein each piston is movable along the major cylindrical axis between an up most position to a down most position within the respective cylinder as the cylinder bank rotates, each piston having a connecting rod and a connecting rod end remote from the piston; and a thrust plate operatively connected to the remote ends of the connecting rods, the thrust plate being rotatably mounted to the stationary housing about a thrust axis and in a thrust plane, wherein the thrust plate is rotationally offset about the thrust axis and with respect to a reference point in the thrust plane.

23. The engine block assembly of claim 22, wherein the major cylinder axes are tilted with respect to the central longitudinal axis, so that each piston dwells about the up most position as the cylinder bank rotates thereby permitting a substantially constant volume combustion process to take place within each combustion chamber.

24. The engine block assembly of claim 22, wherein each piston sequentially moves from the down most position within the cylinder to the up most position within the cylinder during a first portion of rotation of the cylinder bank, wherein each piston sequentially dwells about the up most position for substantially all of an air-fuel mixture to be combusted within the combustion chamber, and wherein each piston then sequentially moves from about the up most position to the down most position during a second portion of rotation of the cylinder.

25. The engine block assembly of claim 24, wherein each piston moves substantially faster during the second portion of rotation than during the first portion of rotation.

26. An engine block assembly comprising:

a stationary housing;

a cylinder bank rotatably mounted to the stationary housing about a central longitudinal axis, the cylinder bank having a plurality of cylinders therein radially distanced from the central longitudinal axis, each cylinder having associated therewith a cylinder wall formed about a major cylinder axis;

a plurality of pistons wherein one piston is provided in each cylinder to form a combustion chamber therein, wherein each piston is movable along the major cylindrical axis between an up most position to a down most position within the respective cylinder as the cylinder bank rotates, each piston having a connecting rod and a connecting rod end remote from the piston; and a thrust plate operatively connected to the remote ends of the connecting rods, the thrust plate being rotatably mounted to the stationary housing about a thrust axis that does not intersect with the central longitudinal axis.

27. The engine block assembly of claim 26, wherein the major cylinder axes are tilted with respect to the central longitudinal axis, so that each piston dwells about the up most position as the cylinder bank rotates thereby permitting a substantially constant volume combustion process to take place within each combustion chamber.

28. The engine block assembly of claim 26, wherein each piston sequentially moves from the down most position within the cylinder to the up most position within the cylinder during a first portion of rotation of the cylinder bank, wherein each piston sequentially dwells about the up most position for substantially all of an air-fuel mixture to be combusted within the combustion chamber, and wherein each piston then sequentially moves from about the up most position to the down most position during a second portion of rotation of the cylinder.

29. The engine block assembly of claim 28, wherein each piston moves substantially faster during the second portion of rotation than during the first portion of rotation.

30. An engine block assembly comprising:

a stationary housing;

a cylinder bank rotatably mounted to the housing about a central longitudinal axis, the cylinder bank having a plurality of cylinders therein radially distanced from the central longitudinal axis, each cylinder having associated therewith a cylinder wall formed about a major cylinder axis;

a plurality of pistons wherein one piston is provided in each cylinder to form a combustion chamber therein, wherein each piston sequentially moves from an up most position within the cylinder to a down most position within the cylinder during a first portion of rotation of the cylinder bank and wherein each piston then sequentially moves between the down most position to the up most position during a second portion of rotation of the cylinder bank; and wherein the first portion of rotation of the cylinder bank is less than 180.degree., so that each piston moves faster during the first portion of rotation than during the second portion of rotation;

a plurality of connecting rods each having a proximal end attached to a respective piston, and a remote end distant from the respective piston; and a thrust plate operatively connected to the ends of the connecting rods, the thrust plate being rotatably mounted to the stationary housing about a thrust axis and in a thrust plane, wherein the thrust plane forms an oblique angle with respect to a plane that is perpendicular to the central longitudinal axis.

31. The engine block assembly of claim 30, wherein each piston sequentially dwells about the up most position resulting in a substantially constant volume combustion cycle within each combustion chamber.

32. The engine block assembly of claim 31, wherein the substantially constant volume combustion cycle is created by adjusting one or more of the following design parameters: (1) the angle of the thrust plane with respect to a plane that is perpendicular to the central longitudinal axis, (2) the angular rotational offset of the thrust plate about an axis which is parallel to the central longitudinal axis and which intersects the thrust plate axis, (3) the angular rotational offset of the thrust plate about the thrust plate axis with respect to a reference point in the thrust plane, (4) the lateral offset of the thrust plate axis from the central longitudinal axis, and (5) the tilt of the major cylinder axes with respect to the central longitudinal axis.

33. An engine block assembly comprising:

a stationary housing;

a cylinder bank rotatably mounted to the housing about a central longitudinal axis, the cylinder bank having a plurality of cylinders therein radially distanced from the central longitudinal axis, each cylinder having associated therewith a cylinder wall formed about a major cylinder axis;

a plurality of pistons wherein one piston is provided in each cylinder to form a combustion chamber therein, wherein each piston sequentially moves from a down most position within the cylinder to an up most position within the cylinder during a first portion of rotation of the cylinder bank, wherein each piston sequentially dwells in the up most position for a substantially constant volume combustion cycle to take place within each combustion chamber, and wherein each piston then sequentially moves from about the up most position to the down most position during a second portion of rotation of the cylinder bank;

a plurality of connecting rods each having a proximal end attached to a respective piston, and a remote end distant from the respective piston; and a thrust plate operatively connected to the ends of the connecting rods, the thrust plate being rotatably mounted to the stationary housing about a thrust axis and in a thrust plane, wherein the thrust plane forms an oblique angle with respect to a plane that is perpendicular to the central longitudinal axis.

34. The engine block assembly of claim 33, wherein the piston moves substantially faster during the second portion of rotation of the cylinder bank than during the first portion.

35. The engine block assembly of claim 34, wherein a crank angle duration of the second portion of rotation of the cylinder bank is substantially less than a crank angle duration of the first portion of rotation of the cylinder bank.

36. A method of combusting fuel in an internal combustion engine having a rotating barrel-type cylinder bank configuration in which a piston moves within a cylinder, wherein the piston is operatively connected so as to rotate an output shaft, the method comprising the steps of:

Moving the piston upward in the cylinder while the cylinder bank rotates during a compression stroke, Causing the piston to dwell near a top of the cylinder while the cylinder bank rotates while combusting substantially all of an air-fuel mixture, and Moving the piston downward in the cylinder while the cylinder bank rotates during a power stroke.

37. The method of claim 36, wherein the moving step includes moving the piston downward in the cylinder during the power stroke at a rate which is faster than during the compression stroke.

38. An engine block assembly comprising:

a stationary housing;

a cylinder bank rotatably mounted to the housing about a central longitudinal axis, the cylinder bank having a plurality of cylinders therein radially distanced from the central longitudinal axis, each cylinder having associated therewith a cylinder wall, an intake port, an exhaust port, a valve assembly for opening and closing the intake port, a piston moveable within the cylinder between an up position and a down position, and a connecting member having an inner end connected to the piston and an outer end;

at least one closed-loop passageway self contained within the cylinder bank, each passageway having a hot area and a cooler area;

a heat expansive liquid within the closed-loop passageway which flows from the hot area to the cooler area as the cylinder bank rotates; and a thrust plate operatively connected to the outer ends of the connecting members and operatively engaged with the cylinder bank so that the thrust plate rotates in synchronization therewith, the thrust plate being rotatably mounted in a thrust plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank.

39. An internal combustion engine block assembly comprising:

a stationary housing;

a cylinder bank rotatably mounted to the housing about a central longitudinal axis, the cylinder bank having a cylinder carriage, a plurality of cylinders each of which has a lower end mounted to the cylinder carriage and an upper end, and a plurality of cooling fins thereon;

a cylinder head fixedly mounted to the upper ends of the plurality of cylinders for rotation therewith, the cylinder head having associated with each of the plurality of cylinders an intake port, an exhaust port, a valve assembly for opening and closing the intake port and the exhaust port in a timed sequence, and a plurality of cooling slots therein;

a plurality of pistons, each of which is moveable within a respective one of the plurality of cylinder between an up position and a down position, a plurality of connecting members, each of which has an inner end connected to a respective one of the plurality of pistons and an outer end; a thrust plate operatively connected to the outer ends of the connecting members and operatively engaged with the cylinder bank so that the thrust plate rotates in synchronization therewith, the thrust plate being rotatably mounted in a thrust plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank; and an air compressor for receiving ambient air through an air intake, and for providing a first portion of compressed air to the plurality of cooling slots in the cylinder head for cooling thereof, a second portion of compressed air across the cooling fins in the cylinder bank for cooling thereof; and a third portion of compressed air into the plurality of cylinders for combustion.

40. An engine block assembly comprising:

a stationary housing having an exhaust manifold thereon, a back pressure passageway adjacent the exhaust manifold, and at least one seal adjacent to the back pressure passageway;

a cylinder bank rotatably mounted to the housing about a central longitudinal axis, the cylinder bank having a plurality of cylinders therein radially distanced from the central longitudinal axis, each cylinder having associated therewith a cylinder wall, an intake port, an exhaust port which opens to the exhaust manifold, a valve for opening and closing the intake port, a piston moveable within the cylinder between an up position and a down position, and a connecting member having an inner end connected to the piston and an outer end;

an air compressor for providing compressed air to the back pressure passageway to back pressure the seal; and a thrust plate operatively connected to the outer ends of the connecting members and operatively engaged with the cylinder bank so that the thrust plate rotates in synchronization therewith, the thrust plate being rotatably mounted in a thrust plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank.

41. An engine comprising:

a stationary housing;

a cylinder bank rotatably mounted to the housing about a central longitudinal axis, the cylinder bank having a cylinder carriage, and a plurality of cylinders each of which has a lower end mounted to the cylinder carriage and an upper end;

a cylinder head fixedly mounted to the upper ends of the plurality of cylinders for rotation therewith, the cylinder head having associated with each of the plurality of cylinders an intake port, an exhaust port, and a valve assembly for opening and closing the intake port and the exhaust port in a timed sequence;

a plurality of pistons, each of which is moveable within a respective one of the plurality of cylinder between an up position and a down position;

a plurality of connecting members, each of which has an inner end connected to a respective one of the plurality of pistons and an outer end;

a thrust plate operatively connected to the outer ends of the connecting members and operatively engaged with the cylinder bank so that the thrust plate rotates in synchronization therewith, the thrust plate being rotatably mounted in a thrust plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank;

an air compressor for providing compressed air to the plurality of cylinders;

stationary fuel injector means for injecting fuel into the compressed air to create a fuel-air mixture; and a throttle mounted to the stationary housing and having a variable sized throttle opening through which the fuel air mixture is simultaneously delivered and regulated to the intake ports, the throttle having a throttle control for varying the size of the throttle opening based on engine conditions.

* * * * *